US008877020B2

(12) United States Patent
Yamamoto et al.

(10) Patent No.: US 8,877,020 B2
(45) Date of Patent: Nov. 4, 2014

(54) ELECTROLYTIC REGENERATION UNIT AND ELECTROLYTIC REGENERATION APPARATUS USING SAME

(75) Inventors: Hisamitsu Yamamoto, Hirakata (JP); Masayuki Utsumi, Hirakata (JP); Yoshikazu Saijo, Hirakata (JP); Tomoji Okuda, Hirakata (JP); Hiroki Omura, Hirakata (JP)

(73) Assignee: C. Uyemura & Co., Ltd., Osaka (JP)

( * ) Notice: Subject to any disclaimer, the term of this patent is extended or adjusted under 35 U.S.C. 154(b) by 247 days.

(21) Appl. No.: 13/478,873

(22) Filed: May 23, 2012

(65) Prior Publication Data

US 2012/0298505 A1 Nov. 29, 2012

(30) Foreign Application Priority Data

May 24, 2011 (JP) ..... 2011-115689

(51) Int. Cl.
*C25B 9/00* (2006.01)
*C25B 1/21* (2006.01)
*C25B 1/28* (2006.01)

(52) U.S. Cl.
CPC ... *C25B 1/21* (2013.01); *C25B 1/28* (2013.01); *C25B 9/00* (2013.01)
USPC ..... 204/272; 205/475; 205/476

(58) Field of Classification Search
None
See application file for complete search history.

(56) References Cited

U.S. PATENT DOCUMENTS 233,790 A * 10/1880 Montgomery ..... 119/409
4,026,784 A * 5/1977 Rivers ..... 204/273
4,378,276 A * 3/1983 Liggett et al. ..... 205/751
4,525,272 A * 6/1985 Henson ..... 210/149
4,713,170 A * 12/1987 Saibic ..... 210/85
4,834,858 A * 5/1989 Barber ..... 204/225
4,936,979 A * 6/1990 Brown ..... 210/85
5,062,930 A * 11/1991 Dillon et al. ..... 205/475
5,460,702 A * 10/1995 Birkbeck et al. ..... 210/748.17
5,753,100 A * 5/1998 Lumsden ..... 205/701
5,833,842 A * 11/1998 Fields ..... 210/85
5,893,977 A * 4/1999 Pucci ..... 210/739
5,928,481 A * 7/1999 Briggs ..... 210/192
6,059,942 A * 5/2000 Barnes et al. ..... 204/269
6,267,885 B1 * 7/2001 Briggs et al. ..... 210/205
6,270,680 B1 * 8/2001 Silveri et al. ..... 210/746
6,652,721 B2 * 11/2003 Kempe ..... 204/412

(Continued)

FOREIGN PATENT DOCUMENTS

JP 06-306667 A * 11/1994
JP 10-245443 A * 9/1998
JP 3301341 B2 4/2002
JP 2012-067380 A * 4/2012

*Primary Examiner* — Harry D Wilkins, III
(74) *Attorney, Agent, or Firm* — Sughrue Mion, PLLC

(57) ABSTRACT

An anode pipe includes a main pipe portion and a secondary pipe portion. The anode pipe has an inner circumferential surface that functions as an anode. The main pipe portion has a first connection end portion and a second connection end portion. The main pipe portion forms a flow channel for a treatment liquid that continues from the first connection end portion to the second connection end portion. The secondary pipe portion extends in a tubular fashion from the intermediate section of the main pipe portion. The interior of the secondary pipe portion communicates with the flow channel inside the main pipe portion. The cathode is disposed at a distance from the inner circumferential surface of the anode pipe. The cathode extends from a cathode attachment end portion toward the main pipe portion inside the secondary pipe portion.

14 Claims, 14 Drawing Sheets

(56) References Cited

U.S. PATENT DOCUMENTS

| | | | | |
|---|---|---|---|---|
| 6,949,184 | B2 * | 9/2005 | Ashton | 210/198.1 |
| 7,056,424 | B2 * | 6/2006 | De Boer et al. | 204/290.01 |
| 7,351,331 | B2 * | 4/2008 | Birkbeck | 210/167.11 |
| 7,374,655 | B2 * | 5/2008 | Roberts et al. | 205/701 |
| 7,695,613 | B2 * | 4/2010 | Doyle et al. | 210/85 |
| 7,879,208 | B2 * | 2/2011 | Wu et al. | 204/278.5 |
| 8,603,331 | B1 * | 12/2013 | Koble | 210/167.11 |
| 2005/0029118 | A1 * | 2/2005 | Holstein et al. | 205/618 |
| 2011/0048964 | A1 * | 3/2011 | Luebke et al. | 205/687 |
| 2011/0259761 | A1 * | 10/2011 | McGuire et al. | 205/755 |
| 2012/0048728 | A1 * | 3/2012 | Saijo et al. | 204/237 |

* cited by examiner

ELECTROLYTIC REGENERATION UNIT AND ELECTROLYTIC REGENERATION APPARATUS USING SAME

BACKGROUND OF THE INVENTION

1. Field of the Invention

The present invention relates to an electrolytic regeneration unit for electrolyzing and regenerating a treatment liquid used in desmearing in the process of manufacturing printed wiring boards and the like, and also to an electrolytic regeneration apparatus using the electrolytic regeneration unit.

2. Background Art

When through holes or via holes are formed with a drill or a laser in resin substrates for use in printed wiring boards, smear, which is resin debris, is generated by the heat caused by friction between the drill or laser and the resin. In order to maintain electric connection reliability in the printed wiring boards, it is necessary to perform a treatment (desmearing treatment) of removing the smear generated in the through holes or via holes by using a chemical treatment method or the like.

A solution of a permanganate such as sodium permanganate and potassium permanganate is typically used as a treatment liquid in the aforementioned chemical treatment method. The treatment liquid is stored in a desmearing tank. Where the resin substrate is immersed in the treatment liquid in the desmearing tank and desmearing is performed, the smear is oxidized and removed from the through holes or via holes. In this process, the permanganate in the treatment liquid is converted into a manganate. Accordingly, in order to reuse the treatment liquid after the treatment for desmearing, an electrolytic regeneration treatment is performed for converting the manganate contained in the treatment liquid into the permanganate.

The conventional electrolytic regeneration apparatus is provided with an electrolytic regeneration tank in which the treatment liquid is stored, electrodes immersed in the treatment liquid in the electrolytic regeneration tank, a feed pipe that feeds the treatment liquid discharged from the desmearing tank into the electrolytic regeneration tank, and a return pipe that feeds the treatment liquid after the electrolytic regeneration to the desmearing tank. The treatment liquid circulates between the desmearing tank and the electrolytic regeneration tank. In such an electrolytic regeneration apparatus, a plurality of electrodes is usually provided inside the electrolytic regeneration tank to improve the regeneration efficiency (see, for example, Japanese Patent Publication No. 3301341).

However, in a system in which a plurality of electrodes are provided inside the electrolytic regeneration tank as described hereinabove, it is necessary to increase the capacity of the electrolytic regeneration tank (the capacity is about 1 time to 2 times that of the desmearing tank), the installation surface area for installing the electrolytic regeneration tank should be ensured, and the bath amount (liquid amount) increases.

SUMMARY OF THE INVENTION

It is an object of the present invention to provide an electrolytic regeneration unit and an electrolytic regeneration apparatus that can be reduced in size and that enables the reduction of bath amount.

The present invention relates to an electrolytic regeneration unit for use in an electrolytic regeneration apparatus for electrolyzing and regenerating a treatment liquid used for desmearing in a desmearing tank. The electrolytic regeneration unit is provided with an anode pipe having an inner circumferential surface functioning as an anode, and a cathode disposed inside the anode pipe at a distance from the inner circumferential surface of the anode pipe. The anode pipe includes a main pipe portion and a secondary pipe portion. The main pipe portion has a first connection end portion for connecting one pipe and a second connection end portion for connecting another pipe other than the one pipe, and forms a flow channel for the treatment liquid that continues from the first connection end portion to the second connection end portion. The secondary pipe portion has a cathode attachment end portion for attaching the cathode, extends in a tubular fashion from an intermediate section of the main pipe portion. The interior of the secondary pipe communicates with the flow channel inside the main pipe portion. The cathode extends inside the secondary pipe portion from the cathode attachment end portion toward the main pipe portion.

DETAILED DESCRIPTION OF THE PREFERRED EMBODIMENTS OF THE INVENTION

An electrolytic regeneration processing unit according to an embodiment of the present invention and an electrolytic regeneration apparatus equipped with the unit will be explained below in greater detail with reference to the appended drawings.

<Entire Configuration>

Figure 1:
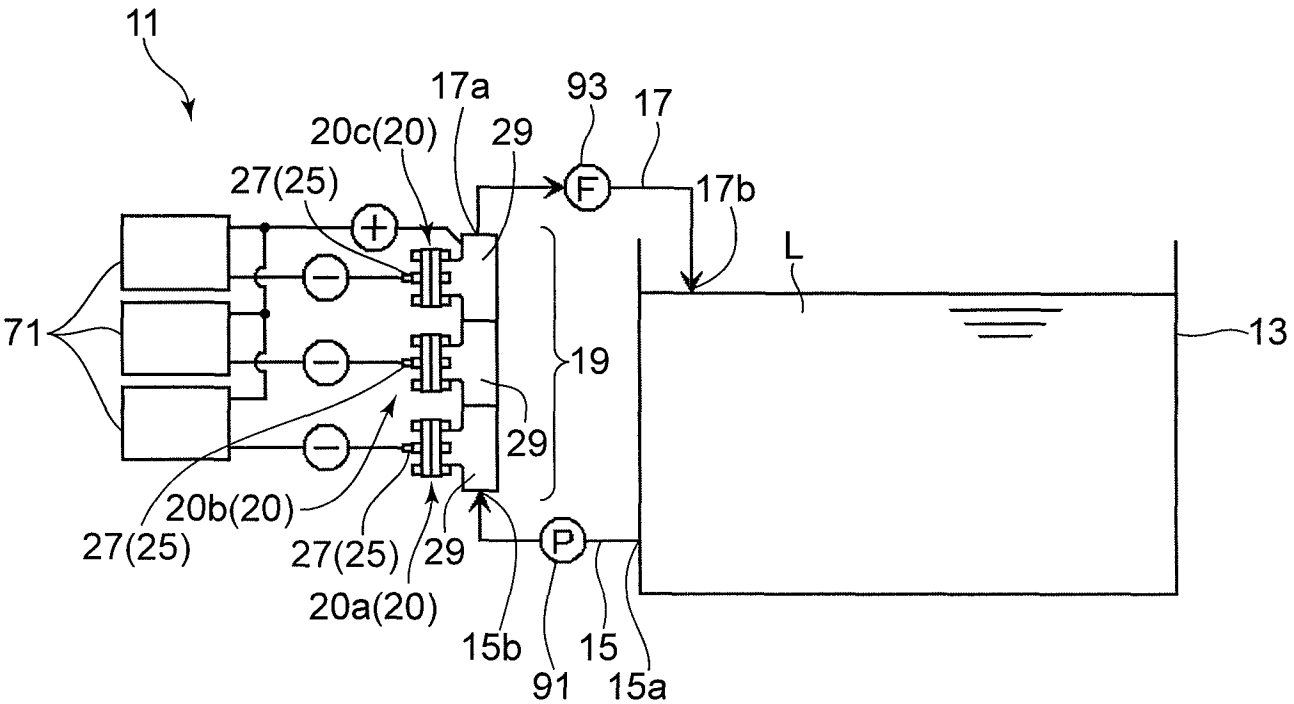
FIG. 1 is a front view illustrating an electrolytic regeneration apparatus provided with electrolytic regeneration units according to one embodiment of the present invention and a desmearing tank to which the electrolytic regeneration apparatus is connected.

FIG. 1 is a schematic diagram illustrating an electrolytic regeneration apparatus 11 equipped with an electrolytic regeneration unit 20 according to the present embodiment and a desmearing tank 13 connected to the electrolytic regeneration apparatus 11. The electrolytic regeneration apparatus 11 shown in FIG. 1 serves to electrolyze and regenerate a treatment liquid L with the object of reusing the treatment liquid L that has been used for desmearing performed to remove the smear in the process for fabricating printed wiring boards. A permanganate solution such as sodium permanganate and potassium permanganate can be used as the treatment liquid L. The treatment liquid L is stored in the desmearing tank 13.

A resin substrate (not shown in the figure) constituting the substrate portion of the printed wiring board is desmeared by immersion in the treatment liquid in the desmearing tank 13. As a result, the smear present in through holes or via holes of the resin substrate is oxidized by the treatment liquid L, and the smear is removed from the through holes and via holes. Meanwhile, part of the permanganate is reduced into a manganate in the treatment liquid L used for the desmearing process. Therefore, in order to reuse the treatment liquid for removing the smear, the treatment liquid L is subjected to electrolytic regeneration by which the manganate is oxidized into the permanganate in the electrolytic regeneration apparatus 11.

<Electrolytic Regeneration Apparatus>

As shown in FIG. 1, the electrolytic regeneration apparatus 11 is provided with a feed pipe 15, a return pipe 17, a unit assembly 19, a pump 91, and a filter 93. The unit assembly 19 is provided with a plurality of electrolytic regeneration units 20 (20*a*, 20*b*, 20*c*). The electrolytic regeneration unit 20 will be sometimes referred to hereinbelow simply as the treatment unit 20.

In the present embodiment, the unit assembly 19 is provided with three electrolytic regeneration units 20 connected in series, but such a configuration is not limiting. The unit assembly 19 may be configured such that a plurality of electrolytic regeneration units 20 are connected in parallel to the feed pipe 15 and the return pipe 17. Further, the unit assembly 19 may be configured to be provided with a multiplicity of electrolytic regeneration units 20, as will be described hereinbelow (see FIG. 13). The electrolytic regeneration apparatus 11 may be also configured to include only one electrolytic regeneration unit 20. In the electrolytic regeneration apparatus 11 of the present embodiment, an upstream end portion 15*a* of the feed pipe 15 is connected to a side surface of the desmearing tank 13. A downstream end portion 15*b* of the feed pipe 15 is connected to an upstream end portion of the unit assembly 19 (upstream end portion of the treatment unit 20*a*).

An upstream end portion 17*a* of the return pipe 17 is connected to a downstream end portion of the unit assembly 19 (downstream end portion of the treatment unit 20*c*). A downstream end portion 17*b* of the return pipe 17 is provided at a position such that the treatment liquid L can be caused to flow into the desmearing tank 13. More specifically, in the present embodiment, the downstream end portion 17*b* of the return pipe 17 is disposed above the surface of the treatment liquid L or in the treatment liquid L stored in the desmearing tank 13.

The pump 91 is provided in the intermediate section of the feed pipe 15. Where the pump 91 is driven, the treatment liquid L is discharged from the desmearing tank 13 and pumped through the feed pipe 15 into the unit assembly 19. The treatment liquid L is electrolyzed in the unit assembly 19. The electrolyzed and regenerated treatment liquid L is pumped through the return pipe 17 into the desmearing tank 13.

The filter 93 is provided in the intermediate section of the return pipe 17. In the unit assembly 19, sludge (manganese dioxide) is formed by electrolytic regeneration on the surface of a cathode 25. The sludge is removed by the flow of the treatment liquid L from the surface of the cathode 25 and pumped together with the treatment liquid L into the return pipe 17. The filter 93 traps the sludge contained in the treatment liquid L. The filter 93 is periodically replaced or the sludge that has adhered to the filter 93 is periodically removed.

It is also possible to provide a plurality of filters 93 in the return pipe 17. Further, instead of providing the filter 93 in the return pipe 17, it is also possible to provide a small tank (not shown in the figure) for sludge removal in the return pipe 17.

<Electrolytic Regeneration Unit>

Figure 2:
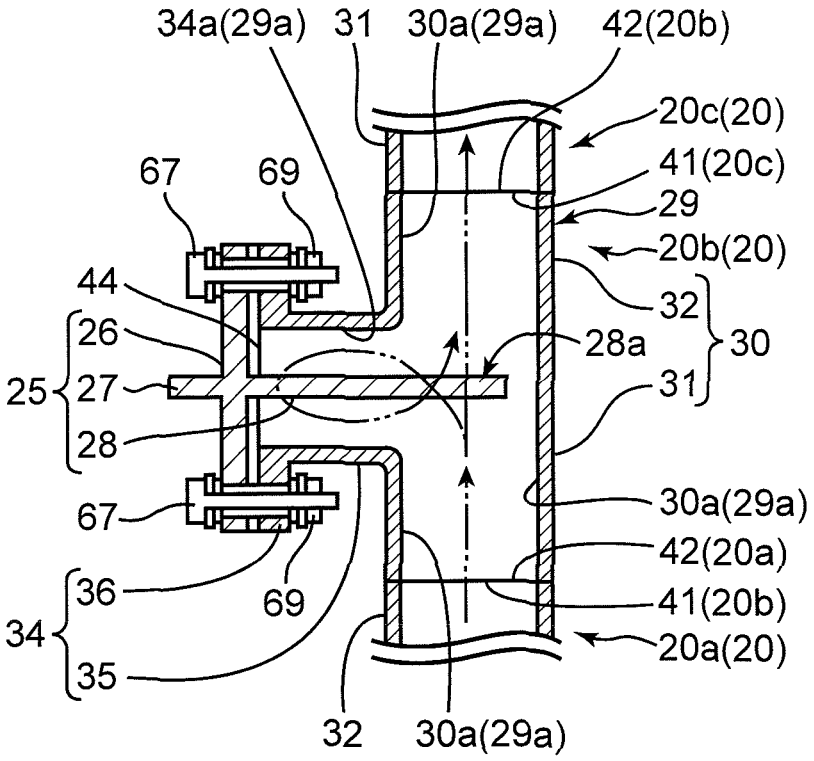
FIG. 2 is a cross-sectional view illustrating the electrolytic regeneration unit.

The treatment unit 20 shown in FIG. 2 is a treatment unit 20*b* positioned in the center, from among the three treatment units 20 (20*a*, 20*b*, 20*c*) of the unit assembly 19 shown in FIG. 1. The treatment units 20 have a similar structure. Each treatment unit 20 is provided with an anode pipe 29 and a cathode 25.

In the present embodiment, the anode pipe 29 is a T-shaped pipe. The anode pipe 29 includes a main pipe portion 30 and a secondary pipe portion 34. The main pipe portion 30 includes a cylindrical first main pipe portion 31 and a cylindrical second main pipe portion 32 and has a linearly extending shape. The secondary pipe portion 34 branches off close to the center of the main pipe portion 30 in the longitudinal direction and extends in the direction perpendicular to the main pipe portion 30. The space inside the secondary pipe portion 34 communicates with a flow channel inside the main pipe portion 30. In the present embodiment, the secondary pipe portion 34 includes a cylindrical portion 35 extending cylindrically from the main pipe portion 30 and an annular flange portion 36 expanding outward in the radial direction from the distal end of the cylindrical portion 35.

The anode pipe 29 has a first connection end portion 41 positioned at the distal end of the first main pipe portion 31, a second connection end portion 42 positioned at the distal end of the second main pipe portion 32, and a cathode attachment end portion 44 positioned at the distal end of the secondary pipe portion 34. Various pipes can be connected to the first connection end portion 41 and the second connection end portion 42. When no pipes are connected, those connection end portions 41, 42 are open. The cathode attachment end portion 44 is open when the cathode 25 is not attached.

As shown in FIG. 1 and FIG. 2, the second connection end portion 42 of the treatment unit 20*a* is connected to the first connection end portion 41 of the treatment unit 20*b*. The first connection end portion 41 of the treatment unit 20*c* is connected to the second connection end portion 42 of the treatment unit 20*b*. The downstream end portion 15*b* of the return pipe 15 is connected to the first connection end portion 41 of the treatment unit 20*a*, and the upstream end portion 17*a* of the return pipe 17 is connected to the second connection end portion 42 of the treatment unit 20*c*.

For example, a method of welding the end portions together can be used for connecting the anode pipes 29 and for connecting the anode pipe 29 and the feed pipe 15 (or return pipe 17). Further, the pipes may be connected together by couplers (not shown in the figure). A structure in which the end portions of the pipes are screwed together, as described hereinbelow, can be also used (see FIG. 4).

The anode pipe 29 is formed from an electrically conductive material. An inner circumferential surface 29*a* of the anode pipe 29 functions as an anode. The inner circumferential surface 29*a* of the anode pipe 29 includes an inner circumferential surface 30*a* of the main pipe portion 30 and an inner circumferential surface 34*a* of the secondary pipe portion 34. Examples of electrically conductive materials include metals, for example, stainless steel and copper, but such selection is not limiting, and other metals may be used or electrically conductive materials other than metals may be also used. An example of suitable stainless steel is SUS316 that excels in alkali resistance and resistance to reagents. The space inside the main pipe portion 30 in the anode pipe 29 mainly functions as a flow channel for the treatment liquid L. The treatment liquid L flows in the direction shown by a solid line arrow in FIG. 1 and flows in the direction shown by a two-dot-dash line in FIG. 2.

Figure 3:
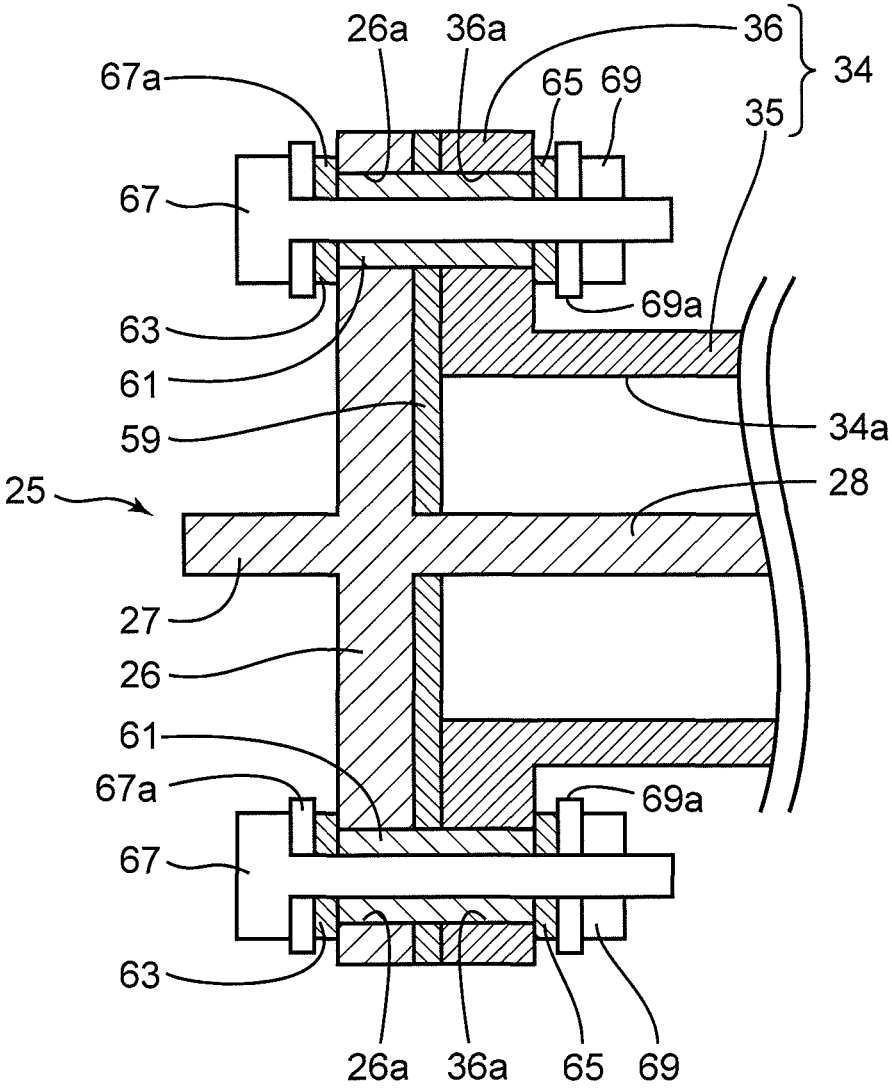
FIG. 3 is an enlarged cross-sectional view of part of the configuration shown in FIG. 2.

In the present embodiment, as shown in FIG. 2 and FIG. 3, the cathode 25 includes a base portion 26, an extending portion 28, and a wiring connection portion 27. The base portion 26 is attached to the cathode attachment end portion 44, which is the distal end portion of the secondary pipe portion 34, and closes the opening of the secondary pipe portion 34. The extending portion 28 extends along the direction from the base portion 26 toward the secondary pipe portion 34. The wiring connection portion 27 is a part where the wiring of a rectifier 71 is connected. In the present embodiment, the base portion 26, the extending portion 28, and the wiring connection portion 27 are molded integrally, but such a configuration is not limiting.

The base portion 26 is a disk-like portion having an outer diameter about the same as that of the flange portion 36 of the secondary pipe portion 34. The base portion 26 is disposed opposite the flange portion 36, with a disk-like insulating packing 59 being interposed therebetween. The insulating packing has an outer diameter about the same as that of the base portion 26.

A plurality of screw insertion holes 26*a* is formed along the circumferential direction in the base portion 26. A plurality of screw insertion holes 36*a* is formed in the flange portion 36 at positions corresponding to the screw insertion holes 26*a* of the base portion 26. In a state in which the positions of those screw insertion holes 26*a*, 36*a* are matched, cylindrical insulating sleeves 61 are inserted into the screw insertion holes 26*a*, 36*a*. A bolt 67 is inserted into each insulating sleeve 61, and a nut 69 is screwed on the distal end portion of the bolt.

An annular insulting washer 63 and an annular washer 67*a* are interposed between the bolt 67 and the base portion 26. An annular insulating washer 65 and an annular washer 69*a* are interposed between the nut 69 and the flange portion 36. The opening of the secondary pipe portion 34 is thus closed in a liquid-tight state by the base portion 26. For example, materials having insulating properties can be used as materials constituting the insulating members. Examples of such materials include synthetic resins and synthetic rubbers. For example, polytetrafluoroethylene can be used as the synthetic resin.

The extending portion 28 extends from the inner surface of the base portion 26 in the direction perpendicular to the inner surface. In the present embodiment, the extending portion 28 is disposed so as to pass substantially through the center of the secondary pipe portion 34 at a distance from the inner circumferential surface 29*a* of the anode pipe 29. The extending portion 28 extends beyond the proximal end portion (part branched off from the main pipe portion 30) of the secondary pipe portion 34 to the flow channel inside the main pipe portion 30. The distal end portion 28*a* of the extending portion 28 is positioned in the flow channel inside the main pipe portion 30. The extending portion 28 has a rod-like or plate-like shape. The extending portion 28 of the present embodiment is shorter than the extending portion 28 of the below-described treatment unit 20 shown in FIG. 11. The merit of such a configuration is that the operation of attaching the cathode 25 to the anode pipe 29 and the operation of replacing the cathode 25 are facilitated.

The flow channel inside the main pipe portion 30, as referred to herein, is a space surrounded by a round columnar inner circumferential surface 30*a* formed by the first main pipe portion 31 and the second main pipe portion 32, as shown in FIG. 2. The flow channel inside the main pipe portion 30, as referred to herein, is a region obtained by subtracting the space surrounded by the inner circumferential surface 34*a* of the secondary pipe portion 34 from the space surrounded by the inner circumferential surface 29*a* of the anode pipe 29. The flow channel inside the main pipe portion 30 is the main path through which the treatment liquid L passes. The treatment liquid L flows not only inside the main pipe portion 30; thus, part thereof flows also inside the secondary pipe portion 34. The treatment liquid L flowing inside the secondary pipe portion 34 moves in a turbulent state through the space between the inner circumferential surface 34*a* of the secondary pipe portion 34 and the extending portion 28 of the cathode 25, returns again into the flow channel inside the main pipe portion 30 and flows toward the downstream side of the flow channel inside the main pipe portion 30.

The pipe connection portion 27 extends from the outer surface of the base portion 26. In the present embodiment, the pipe connection portion 27 extends from the outer surface of the base portion 26 in the direction perpendicular to the outer surface. As shown in FIG. 1, a voltage is applied by the rectifier 71 between the anode pipe 29 and the cathode 25. The rectifier 71 is connected to an outer power supply (not shown in the figure). A negative electrode of the rectifier 71 is connected to the pipe connection portion 27 of each cathode 25, and a positive electrode of the rectifier 71 is connected to the outer circumferential surface of the anode pipe 29. In the present embodiment, the entire anode pipe 29 is constituted by a conductive material. Therefore, by connecting the positive electrode of the rectifier 71 to the outer circumferential surface of the anode pipe 29, it is possible to cause the inner circumferential surface 29*a* to function as an anode.

The cathode 25 is formed from a conductive material. A material constituting the cathode 25 can be a metal, for example copper, but such a selection is not limiting, and other metals or conductive materials other than metals may be also used.

The cathode 25 is preferably formed from copper and an alloy thereof. The reason therefor is described below. Manganese dioxide precipitates on the cathode 25 during the electrolytic regeneration. In order to prevent the manganese dioxide from being admixed as an impurity to the treatment liquid, it is preferred that the manganese dioxide be removed in a suitable manner. Since copper is easily dissolved in a washing solution such as a hydrogen peroxide solution, copper is etched together with manganese dioxide, which has precipitated on the surface of the cathode 25, during washing. As a result, manganese dioxide is easily removed. When the cathode 25 is reduced in size by a plurality of washing cycles, the cathode 25 may be replaced with a new cathode.

Part of the surface of the extending portion 28 of the cathode 25 may be covered by an insulating material (non-conductive material), for example polytetrafluoroethylene. As a result, the surface area of the cathode 25 can be adjusted. In the present embodiment, the cathode 25 has a round columnar shape, but the cathode may also have other shapes such as an angular columnar shape.

The decrease in the distance (inter-electrode distance) between the cathode 25 and the anode pipe 29 facilitates the short circuit caused by deposition of generated manganates on the surface of the cathode 25, but where the distance increases, the electric current flow is inhibited and the voltage used tends to increase. Therefore, the inter-electrode distance is adjusted with consideration for those issues.

In the present embodiment, the feed pipe 15 is directly connected to the unit assembly 19 and configured such that the treatment liquid passes through the flow channel inside the main pipe portion 30 in each treatment unit 20 and through the space surrounded by the inner circumferential surface 34*a* of the secondary pipe portion 34. Therefore, the flow velocity of the treatment liquid flowing in each flow channel and space can be increased over that in the case where the electrolytic regeneration tank is used in the conventional manner. Therefore, in the present embodiment, the effect of removing the manganates generated on the surface of the cathode 25 from the surface of the cathode 25 by the flow of the treatment liquid that has a high flow velocity is higher than that attained in the conventional apparatus. For this reason, in the present embodiment, the inter-electrode distance can be decreased by comparison with the conventional one.

The flow velocity of the treatment liquid L flowing in each flow channel is preferably adjusted, for example to about 5 mm/sec to 100 mm/sec. Where the flow velocity is equal to or greater than 5 mm/sec, an excellent effect of removing (washing away) the sludge generated on the surface of the cathode 25 from the surface of the cathode 25 can be obtained. Meanwhile, where the flow velocity is equal to or less than 100 mm/sec, the contact time of the cathode 25 and the treatment liquid L is prevented from being too short. As a result, the excessive decrease in efficiency of regenerating the treatment liquid L can be inhibited.

In the regeneration treatment (an electric current is passed from the rectifier 71), the flow velocity for the treatment liquid L flowing in each flow channel may be reduced and, after the regeneration treatment has been completed (electric current flow is stopped), the flow velocity may be increased with the object of removing the sludge from the surface of the cathode 25. Such a control may be repeated, for example, with a predetermined period. Such a control may be executed automatically with a control unit (not shown in the figure) or may be executed manually by an operator.

In the present embodiment, because of the above-described configuration, the bath volume of the electrolytic regeneration apparatus 11 (amount of liquid in the electrolytic regeneration apparatus 11) can be made less than the bath volume of the desmearing tank 13 (amount of liquid in the desmearing tank 13). More specifically, the ratio of bath volume of the electrolytic regeneration apparatus 11 and the bath volume of the desmearing tank 13 is preferably about 1:2 to 1:20, more preferably about 1:3 to about 1:10. The bath volume of the electrolytic regeneration apparatus 11 includes not only the bath volume of the unit assembly 19 (amount of liquid in the unit assembly 19), but also the bath volume of the feed pipe 15 (amount of liquid in the feed pipe 15) and the bath volume of the return pipe 17 (amount of liquid in the return pipe 17). In the conventional apparatuses using an electrolytic regeneration tank, the ratio of the bath volume of the electrolytic regeneration apparatus (bath volume of the electrolytic regeneration tank, bath volume of the feed pipe 15, and bath volume of the feed pipe 17) to the bath volume of the desmearing tank is about 2:1 to 1:1.

The anode current density is preferably about 1 A/dm$^2$ to 30 A/dm$^2$. Where the anode current density is equal to or greater than 1 A/dm$^2$, an electric potential between the anode (inner circumferential surface 29*a* of the anode pipe 29) and the cathode 25 can be brought sufficiently close to the regeneration potential ($MnO_4^{2-} \rightarrow MnO_4^- + e^-$) at which manganate ions are electrolyzed to obtain permanganate ions. As a result, the regeneration efficiency can be prevented from decreasing. Meanwhile, where the anode current density is equal to or less than 30 A/dm$^2$, generation of hydrogen can be inhibited and therefore the regeneration efficiency can be prevented from decreasing. The cathode current density is preferably about 0.3 A/dm$^2$ to 30000 A/dm$^2$.

The surface area ratio of the anode and the cathode 25 is preferably about 3:1 to 1000:1. This ratio can be adjusted, for example, by covering part of the surface of the cathode 25 with an insulator as described hereinabove. Where the surface area of the cathode 25 increases, the amount of sludge generated on the surface of the cathode 25 also increases. Therefore, it is preferred that the surface area of the cathode 25 be less than the surface area of the anode.

The electrolytic regeneration temperature (temperature of the treatment liquid L) in the unit assembly 19 is preferably about 30° C. to 90° C. when a solution of a permanganate such as sodium permanganate or potassium permanganate is used as the treatment liquid L. The temperature of the treatment liquid L can be adjusted, for example, by heating each treatment unit 20 or by heating the feed pipe 15 or the return pipe 17. A method by which each pipe 29, the feed pipe 15, and the return pipe 17 are covered with a jacket having a heat source, for example, such as steam or a thermoelectric wire, can be used for heating.

The gas generated by electrolysis moves downstream of the unit assembly 19 together with the flow of the treatment liquid L and is discharged from the unit assembly 19. The gas discharged from the unit assembly 19 is fed downstream together with the treatment liquid L through the return pipe 17. The gas that has been fed downstream together with the treatment liquid L is discharged from the downstream end portion 17*b* of the return pipe 17 and can be collected, if necessary. The gas discharge means will be described below.

<Variation Example 1>

Figure 4:
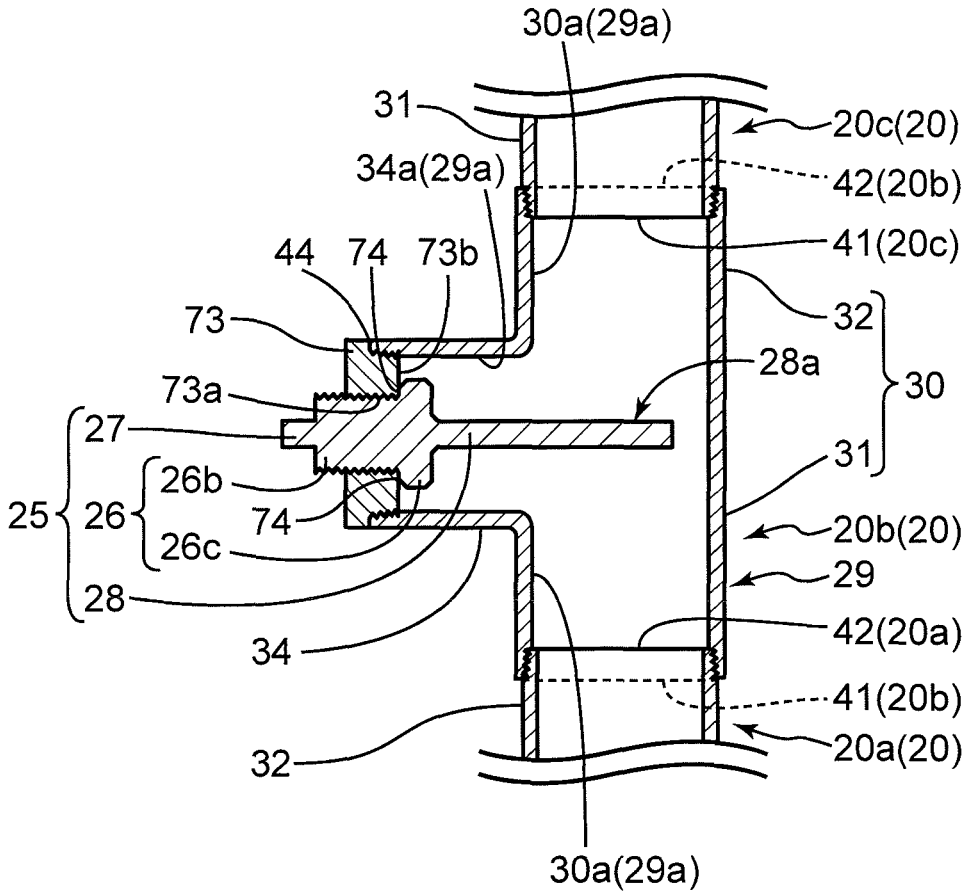
FIG. 4 is a cross-sectional view illustrating Variation Example 1 of the electrolytic regeneration unit.

FIG. 4 is a cross-sectional view illustrating Variation Example 1 of the treatment unit 20. In the treatment unit 20 of Variation Example 1, the connection structure of the first connection end portion 41 and the second connection end portion 42 of the anode pipe 29 and the pipes and also the connection structure of the cathode attachment end portion 44 of the anode pipe 29 and the cathode 25 are different from those of the embodiment illustrated by FIG. 2.

In the treatment unit 20 of Variation Example 1, a screw structure is provided in the first connection end portion 41, the second connection end portion 42, and the cathode attachment end portion 44. More specifically, a female thread is formed at the inner surface of the first main pipe portion 31 in the first connection end portion 41 of the anode pipe 29 in the treatment unit 20*b*, a female thread is formed at the inner surface of the second main pipe portion 32 in the second connection end portion 42, and a female thread is formed at the inner surface of the secondary pipe portion 34 in the cathode attachment end portion 44. Meanwhile, a male thread is formed at the outer surface of the second main pipe portion 32 in the second connection end portion 42 of the anode pipe 29 in the treatment unit 20*a*. A male thread is formed at the outer surface of the first main pipe portion 31 in the first connection end portion 41 of the anode pipe 29 in the treatment unit 20*c*.

Therefore, the treatment unit 20*a* and the treatment unit 20*b* can be connected by screwing the female thread of the first connection end portion 41 of the treatment unit 20*b* onto the male thread of the second connection end portion 42 of the treatment unit 20*a*. Further, the treatment unit 20*b* and the treatment unit 20*c* can be connected by screwing the male thread of the first connection end portion 41 of the treatment unit 20*c* into the female thread of the second connection end portion 42 of the treatment unit 20*b*.

Further, the cathode 25 is attached to the cathode attachment end portion 44, with an insulating member 73 being interposed therebetween. The cathode 25 has the base portion 26, the extending portion 28, and the wiring connection portion 27. The base portion 26, the extending portion 28, and the wiring connection portion 27 are molded integrally by using a conductive material. The opening of the cathode attachment end portion 44 is closed by the base portion 26 and the insulating member 73.

The insulating member 73 has an annular shape, and a male thread is formed at the outer circumferential surface thereof. This male thread is screwed into the female thread of the cathode attachment end portion 44. The insulating member 73 has a through hole 73*a* in the center thereof. A female thread is formed at the inner circumferential surface of the through hole 73*a*. Insulating materials such as described hereinabove can be used for the insulating member 73.

The base portion 26 has a round columnar screw-in portion 26*b* and a round disk-like enlarged-diameter portion 26*c* that has an outer diameter larger than that of the screw-in portion 26*b*. A male thread is formed on the outer circumferential surface of the screw-in portion 26*b*. The male thread is screwed into the female thread of the through hole 73*a* of the insulating member 73.

In Variation Example 1, the enlarged-diameter portion 26*c* has an abutment surface 74 that abuts on an inner surface 73*b* of the insulating member 73 when the enlarge-diameter portion 26*c* is mounted on the insulating member 73 as shown in FIG. 4, but such a configuration is not limiting. The abutment surface 74 is parallel to the direction perpendicular to the longitudinal direction of the cathode 25. By abutting the abutment surface 74 on the inner surface 73*b* of the insulating member 73, it is possible to ensure better liquid tightness between the through hole 73*a* of the insulating member 73 and the base portion 26 of the cathode 25.

The extending portion 28 extends from the main surface (right surface in FIG. 4) of the enlarged-diameter portion 26*c* in the direction perpendicular to the main surface. The wiring connection portion 27 extends from one end (left end in FIG. 4) of the screw-in portion 26*b*.

In Variation Example 1, the enlarged-diameter portion 26*c* is disposed inside the secondary pipe portion 34. The enlarged-diameter portion 26*c* is arranged closer than the insulating member 73 to the main pipe portion 30. As a result, the pressure (liquid pressure) inside the anode pipe 29 acts in the direction of pressing the enlarged-diameter portion 26*c* to the insulating member 73. Therefore, the degree of liquid tightness is prevented from decreasing due to the pressure inside the anode pipe 29.

<Variation Example 2>

Figure 5:
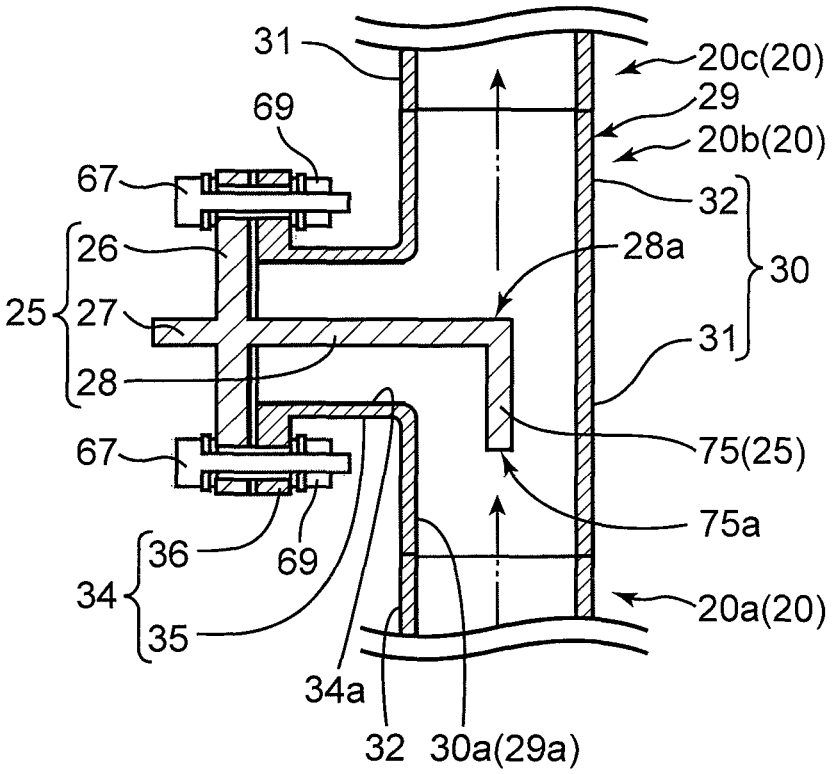
FIG. 5 is a cross-sectional view illustrating Variation Example 2 of the electrolytic regeneration unit.

FIG. 5 is a cross-sectional view illustrating Variation Example 2 of the treatment unit 20. In the treatment unit 20 of Variation Example 2, the shape of the cathode 25 is different from that in the aforementioned embodiment shown in FIG. 2.

As shown in FIG. 5, the cathode 25 has the base portion 26, the wiring connection portion 27, the extending portion 28, and a bent portion 75. The bent portion 75 has a rod-like or plate-like shape similar to that of the extending portion 28. The distal end portion 28*a* of the extending portion 28 extends beyond the proximal end portion of the secondary pipe portion 34 and reaches the flow channel inside the main pipe portion 30. The bent portion 75 bends from the distal end portion 28*a* of the extending portion 28 and extends in the extension direction of the main pipe portion 30. In Variation Example 2, the bent portion 75 extends from the distal end portion 28*a* in the direction opposite the flow direction of the treatment liquid L, but the bent portion may also extend in the flow direction of the treatment liquid L. The entire bent portion 75 is positioned in the flow channel inside the main pipe portion 30.

Since the treatment unit 20 of Variation Example 2 has the bent portion 75 such as described hereinabove, the region in which the cathode 25 and the inner circumferential surface 29*a* of the anode pipe 29 face each other increases and the efficiency of the electrolytic regeneration can be further increased.

Further, the length of the bent portion 75 is less than the inner diameter (diameter) of the secondary pipe portion 34. Therefore, the bent portion 75 and the extending portion 28 of the cathode 25 having the L-like shape can be inserted from the cathode attachment end portion 44 of the secondary pipe portion 34.

Further, a distal end portion 75*a* of the bent portion 75 is positioned on the outside in the radial direction of the secondary pipe portion 34 with respect to the inner circumferential surface 34*a* of the secondary pipe portion 34. The entire circumference of the distal end portion 75*a* of the bent portion 75 is surrounded by the inner circumferential surface 30*a* of the first main pipe portion 31. In the case where the inner circumferential surface 30*a* of the first main pipe portion 31 thus faces the entire circumference of the distal end portion 75*a* of the bent portion 75, the region in which the cathode 25 and the inner circumferential surface 29*a* of the anode pipe 29 face each other is further increased and the efficiency of the electrolytic regeneration can be further increased.

In Variation Example 2, the case is explained by way of example in which the cathode 25 is provided with only one bent portion 75, but a plurality of bent portions 75 may be also provided. For example, a plurality of bent portions 75 may extend radially (for example, in a cross-like configuration) from the distal end portion 28*a* of the extending portion 28 of the cathode 25.

<Variation Example 3>

Figure 6:
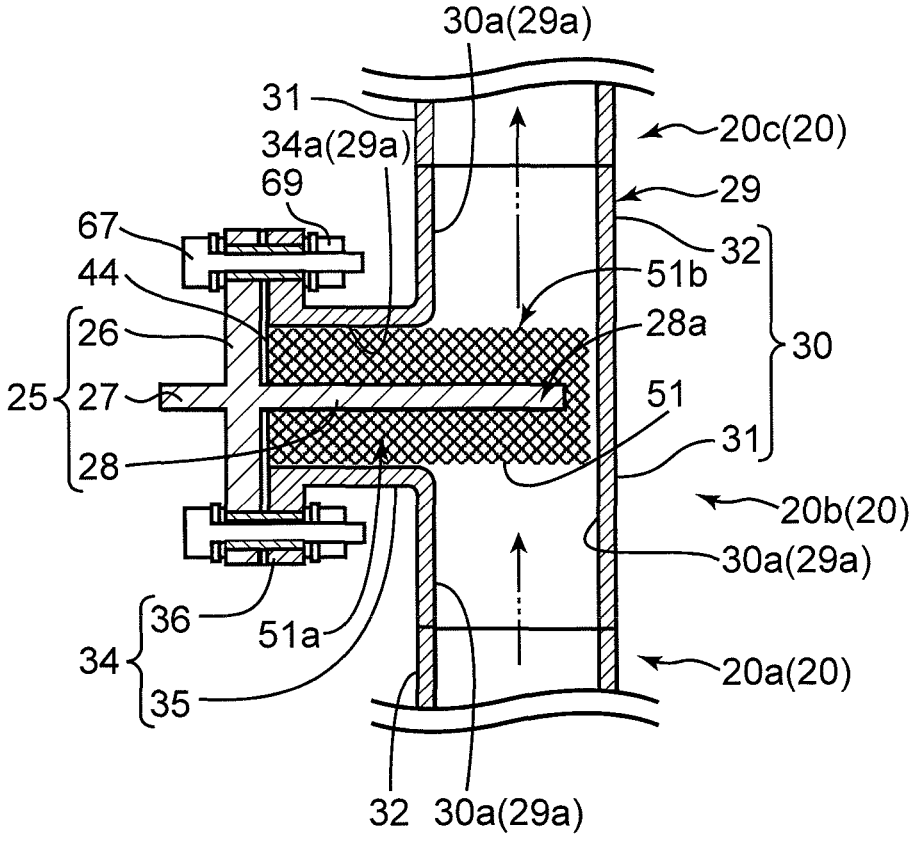
FIG. 6 is a cross-sectional view illustrating Variation Example 3 of the electrolytic regeneration unit.
Figure 7A:
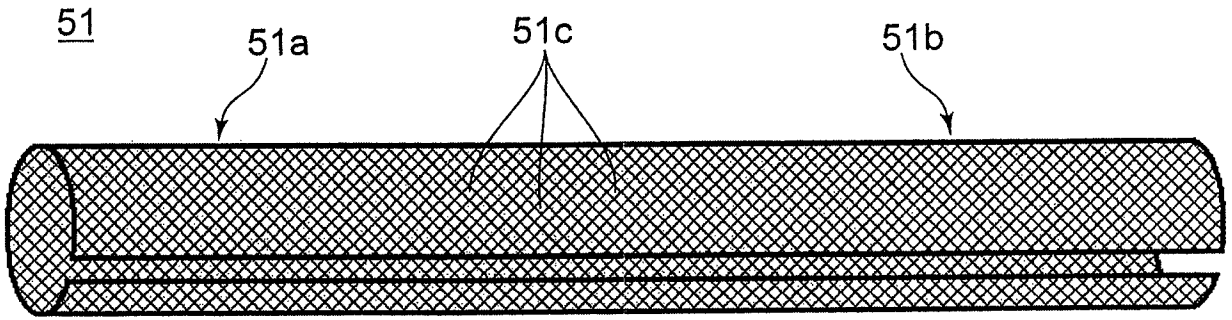
FIG. 7A is a perspective view illustrating an example of the auxiliary anode used in Variation Example 3.
Figure 7B:
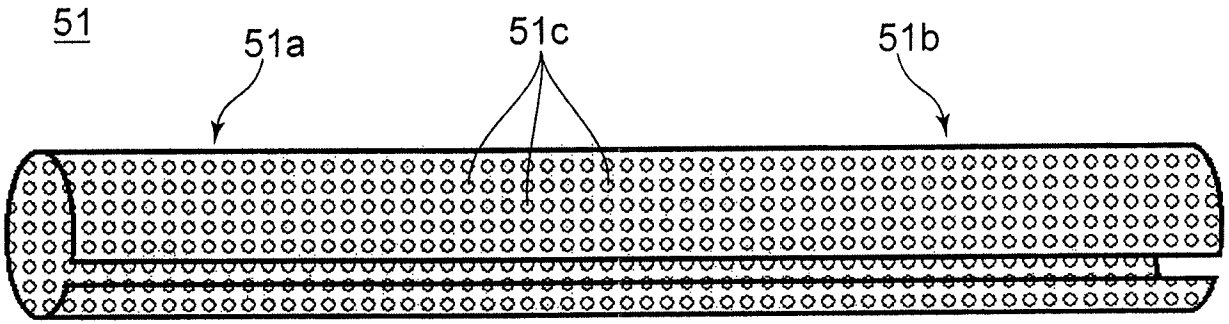
FIG. 7B is a perspective view illustrating another example of the auxiliary anode used in Variation Example 3.

FIG. 6 is a cross-sectional view illustrating Variation Example 3 of the treatment unit 20. FIG. 7A is a perspective view illustrating an example of an auxiliary anode 51 used in Variation Example 3. FIG. 7B is a perspective view illustrating another example of the auxiliary anode 51 used in Variation Example 3. The difference between the treatment unit 20 of Variation Example 3 and the aforementioned embodiment illustrated by FIG. 2 is that the former is further provided with the auxiliary anode 51.

As shown in FIGS. 6, 7A, and 7B, the cathode 25 has an extending portion 28 that extends from the base portion 26 fixed to the cathode attachment end portion 44 of the secondary pipe portion 34 along the extension direction of the secondary pipe portion 34. The distal end portion 28*a* of the extending portion 28 is positioned in the flow channel inside the main pipe portion 30.

The auxiliary anode 51 is disposed opposite the extending portion 28 of the cathode 25 at a distance from the cathode 25. The auxiliary anode 51 has a tubular shape extending along the cathode 25 so as to surround the extending portion 28. A part 51*a* of the auxiliary anode 51 at the proximal end side thereof is in contact with the inner circumferential surface 34*a* of the secondary pipe portion 34. As a result, the auxiliary anode 51 is electrically connected to the anode pipe 29. The entire circumference of the part 51*a* at the proximal end side may be in contact with the inner circumferential surface 34*a* of the secondary pipe portion 34, or only a portion, in the circumferential direction, of the part 51*a* at the proximal end side may be in contact with the inner circumferential surface 34*a* of the secondary pipe portion 34.

A part 51*b* of the auxiliary anode 51 at the distal end side thereof is positioned in the flow channel inside the main pipe portion 30 and surrounds the distal end portion 28*a* of the cathode 25. The part 51*b* of the auxiliary anode 51 at the distal end side thereof faces the distal end portion 28*a*. The auxiliary anode 51 extends beyond the distal end portion 28*a* of the extending portion 28 to the vicinity of the inner circumferential surface 30*a* of the main pipe portion 30.

A plurality of through holes 51*c* are formed over the entire auxiliary anode 51. Since a plurality of through holes 51*c* is thus provided, the treatment liquid L flowing in the flow channel inside the main pipe portion 30 flow through the through holes 51*c* into the auxiliary anode 51 and can flow through the through holes 51*c* to the outside of the auxiliary anode 51 after being subjected to the electrolytic regeneration.

Examples of the auxiliary anodes 51 provided with a plurality of through holes 51*c* include a configuration obtained by rounding a mesh-like conductive sheet to obtain a cylindrical shape such as shown in FIG. 7A and a configuration in which a plurality of through holes 51*c* are formed in a conductive sheet (punching sheet) as shown in FIG. 7B. The auxiliary anode 51 is formed from a conductive material.

For example, a metal can be used as the material (conductive material) of the auxiliary anode 51. More specifically, stainless steel, for example SUS316, and copper can be used as the conductive material, but conductive materials other than metals can be also used. Examples the conductive sheet include metal sheets from stainless steel or copper, but such a configuration is not limiting, and other metal sheet or sheets made from conductive materials other than metals may be also used.

The auxiliary anode 51 is inserted from the cathode attachment end portion 44 of the secondary pipe portion 34 before the cathode 25 is attached to the secondary pipe portion 34. Then, the cathode 25 is attached to the cathode attachment end portion 44 of the secondary pipe portion 34.

In Variation Example 3, the case is explained by way of example in which a plurality of through holes 51*c* are formed in the entire auxiliary anode 51, but a plurality of through holes 51*c* may be also formed only in the part 51*b* of the auxiliary anode 51 at the distal end side thereof that is disposed in the flow channel inside the main pipe portion 30.

<Variation Example 4>

Figure 8:
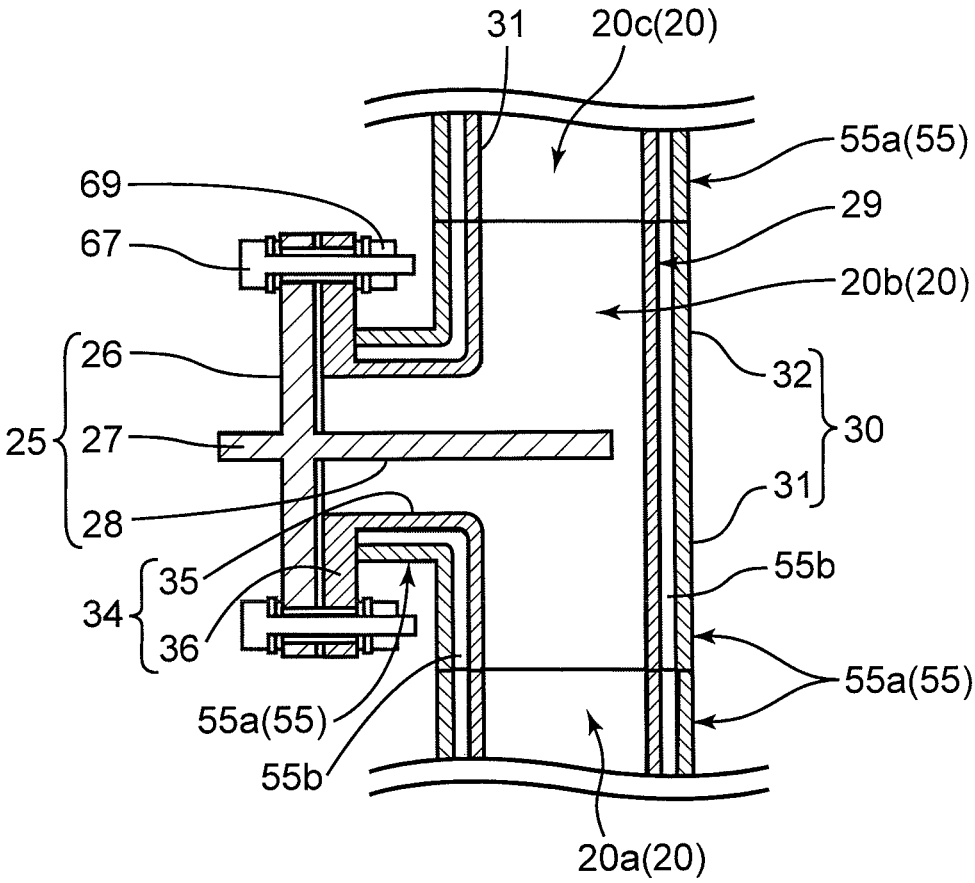
FIG. 8 is a cross-sectional view illustrating Variation Example 4 of the electrolytic regeneration unit.

FIG. 8 is a cross-sectional view illustrating Variation Example 4 of the treatment unit 20. The treatment unit 20 of Variation Example 4 and the aforementioned embodiment illustrated by FIG. 2 differ from each other in that the former is further provided with a temperature adjustment unit 55 for adjusting the temperature of the anode pipe 29.

The temperature adjustment unit 55 in Variation Example 4 includes a jacket 55*a* provided at each anode pipe 29 and a feed mechanism (not shown in the figure). The jacket 55*a* covers substantially the entire outer surface of the anode pipe 29, so that a predetermined gap 55*b* is provided between the jacket and the outer surface of the anode pipes 29. The gap 55*b* is a flow channel for a temperature adjusting fluid (thermal medium) that is fed in by the feed mechanism (not shown in the figure); a liquid such as water or a gas such as air can be used as the temperature adjusting fluid. As a result, the anode pipes 29 can be cooled and/or heated. Therefore, the temperature of the treatment liquid L flowing inside the anode pipe 29 can be adjusted to a desired range. It is preferred that the temperature adjustment unit 55 be further provided with a path for circulating the temperature adjusting fluid.

<Variation Example 5>

Figure 9:
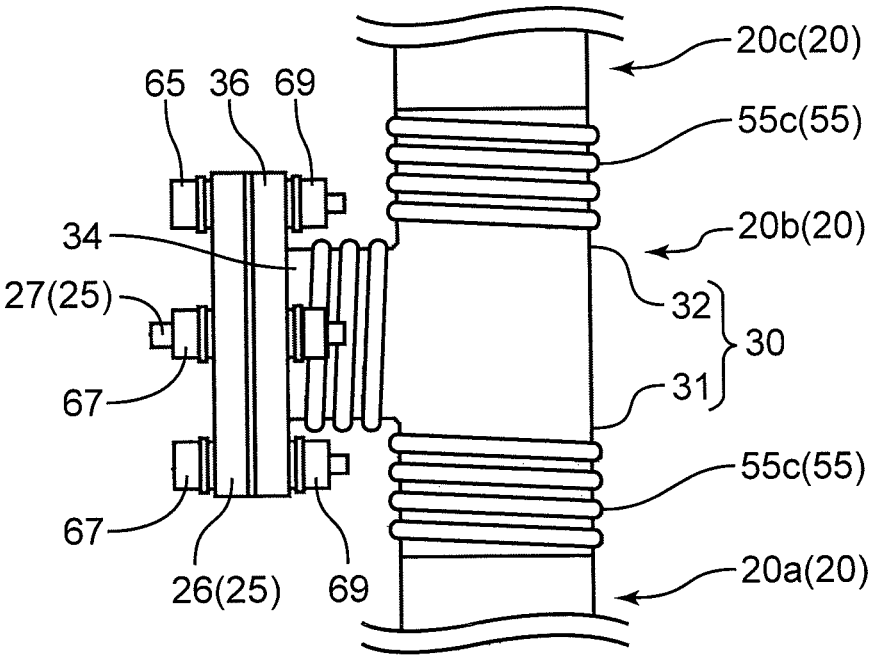
FIG. 9 is a cross-sectional view illustrating Variation Example 5 of the electrolytic regeneration unit.

FIG. 9 is a cross-sectional view illustrating Variation Example 5 of the treatment unit 20. The structure of the temperature adjustment unit 55 in the treatment unit 20 of Variation Example 5 is different from that of Variation Example 4 illustrated by FIG. 8.

The temperature adjustment unit 55 in Variation Example 5 includes a tube 55*c* wounded on each anode pipe 29 and a feed mechanism (not shown in the figure). It is also preferred that the temperature adjustment unit 55 be further provided with a path for circulating the temperature adjusting fluid. The tube 55*c* is wound on the first main pipe portion 31, the second main pipe portion 32, and the secondary pipe portion 34 of each anode pipes 29. The temperature adjusting fluid is fed by the feed mechanism (not shown in the figure) to each tube 55*c*. As a result, each anode pipe 29 can be cooled and/or heated.

<Variation Example 6>

Figure 10:
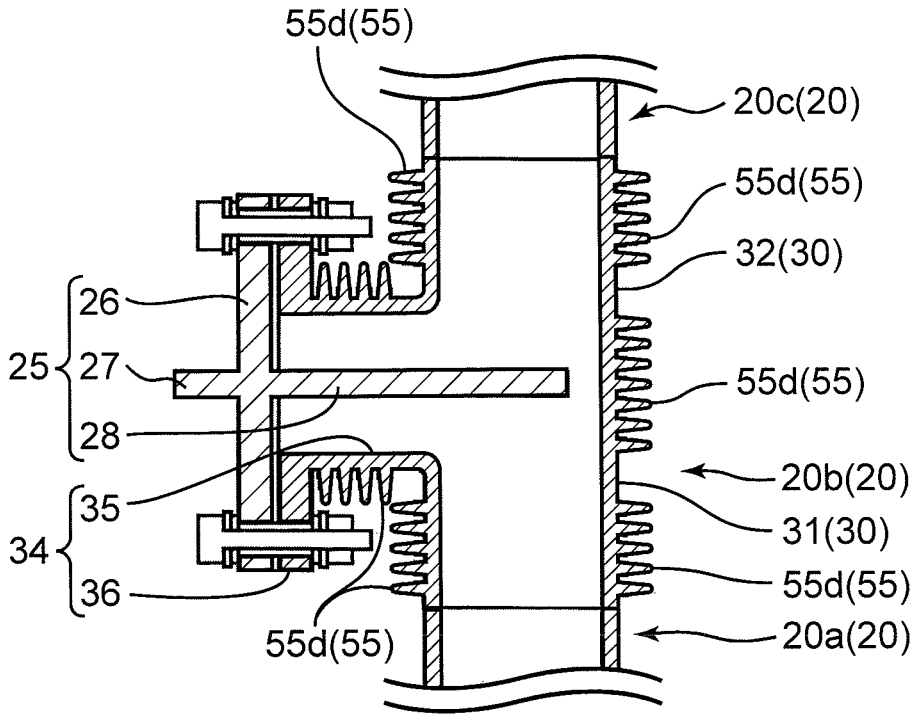
FIG. 10 is a cross-sectional view illustrating Variation Example 6 of the electrolytic regeneration unit.

FIG. 10 is a cross-sectional view illustrating Variation Example 6 of the treatment unit 20. The structure of the temperature adjustment unit 55 in the treatment unit 20 of Variation Example 6 is different from that of Variation Example 4 illustrated by FIG. 8.

The temperature adjustment unit 55 in Variation Example 6 includes fins 55*d* provided at the outer surface of each anode pipe 29. The fins 55*d* are constituted by a large number of protruding pieces that protrude outward in the radial direction from the outer surface of the main pipe portion 30 and the outer surface of the secondary pipe portion 34. The adjacent protruding pieces are arranged with a certain spacing therebetween. The fins 55*d* may be molded integrally with the anode pipe 29 or may be molded separately and then attached to the anode pipe 29.

Since the fins 55*d* have a large surface area, the efficiency of heat exchange with the fluid (air or the like) surrounding the anode pipe 29 can be increased. As a result, each anode pipe 29 can be cooled. Furthermore, each anode pipe 29 can be heated by blowing hot air or the like to the fins 55*d*.

It is preferred that the temperature adjustment unit 55 be further provided with a fan (not shown in the figures) that blows air onto the fins 55*d*. As a result the efficiency of temperature adjustment can be further increased.

<Variation Example 7>

Figure 11:
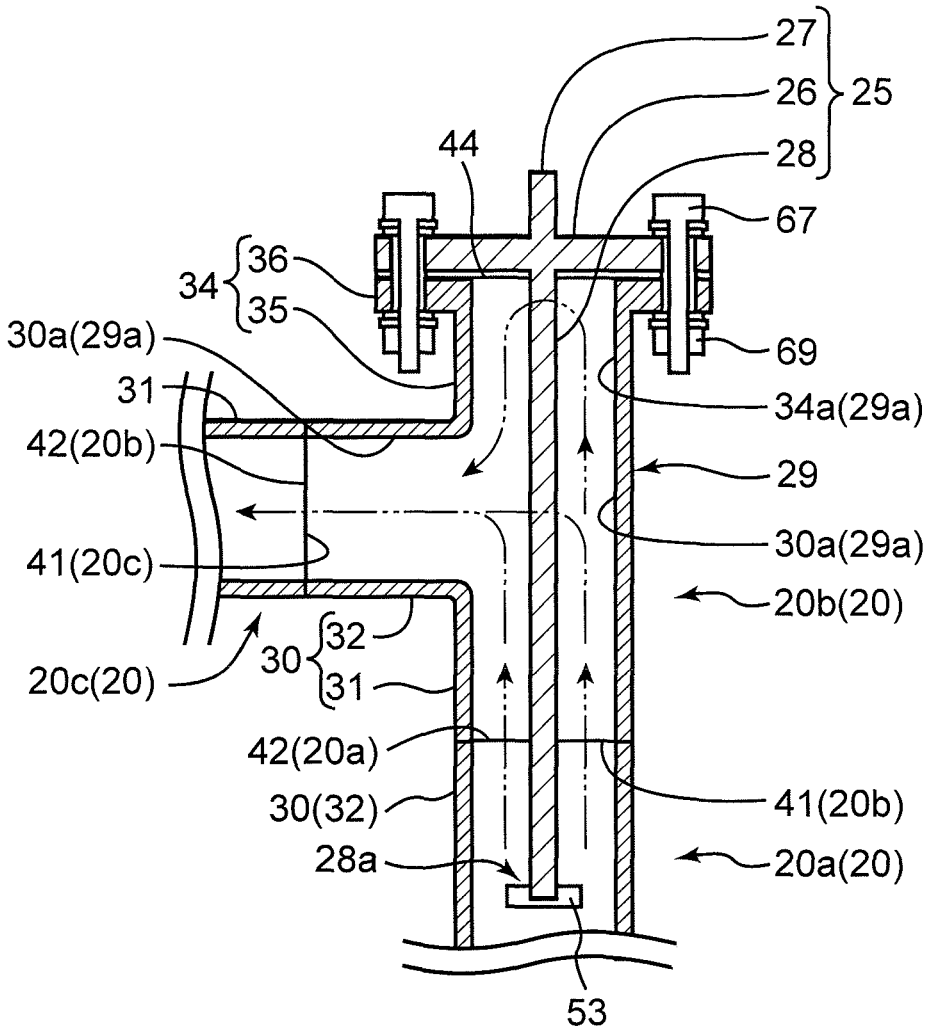
FIG. 11 is a cross-sectional view illustrating Variation Example 7 of the electrolytic regeneration unit.

FIG. 11 is a cross-sectional view illustrating Variation Example 7 of the treatment unit 20. The treatment unit 20 of Variation Example 7 is similar of the aforementioned embodiment illustrated by FIG. 2 in that the anode pipe 29 is a T-shaped pipe, but the arrangement of the main pipe portion 30 forming the main flow channel for the treatment liquid L and the arrangement of the secondary pipe portion 34 having the cathode 25 attached thereto are different from those of the aforementioned embodiment illustrated by FIG. 2.

In Variation Example 7, the main pipe portion 30 has an L-like bent shape. More specifically, the main pipe portion 30 includes the first main pipe portion 31 and the second main pipe portion 32 extending in the mutually perpendicular directions. The secondary pipe portion 34 is connected to the bent portion of the main pipe portion 30 and the secondary pipe portion 34 and the first main pipe portion 31 are arranged along a straight line. Therefore, the treatment liquid L flowing inside the anode pipe 29 mainly flows through the L-shaped space surrounded by the inner circumferential surface 30*a* of the first main pipe portion 31 and the inner circumferential surface 30*a* of the second main pipe portion 32. However, part of the treatment liquid L flows not only in the flow channel inside the main pipe portion 30, but also inside the secondary pipe portion 34. The treatment liquid L that has flown into the inner circumferential surface 34*a* of the secondary pipe portion 34 moves in a turbulent state through the space between the inner circumferential surface 34*a* of the secondary pipe portion 34 and the extending portion 28 of the cathode 25, again returns to the flow channel 30, and flows toward the downstream side of the flow channel inside the main pipe portion 30.

The extending portion 28 of the cathode 25 extends from the inner surface of the base portion 26 along the extension direction of the secondary pipe portion 34. The extending portion 28 extends beyond the secondary pipe portion 34 and reaches the flow channel inside the first main pipe portion 31 connected linearly to the secondary pipe portion 34. Since the secondary pipe portion 34 and the first main pipe portion 31 are thus arranged along a straight line in Variation Example 7, although the length of the secondary pipe portion 34 is equal to the length of the secondary pipe portion 34 in the aforementioned embodiment illustrated by FIG. 2, the length of the extending portion 28 of the cathode 25 can be made larger than that in the aforementioned embodiment illustrated by FIG. 2. As a result, in Variation Example 7, the region where the extending portion 28 of the cathode 25 and the inner circumferential surface 29*a* of the anode pipe 29 face each other can be made larger than in the aforementioned embodiment illustrated by FIG. 2.

Further, the distal end portion 28*a* of the extending portion 28 is positioned in the flow channel inside the main pipe portion 30 of the treatment unit 20*a* connected to the upstream side of the treatment unit 20*b*. Thus, in Variation Example 7, the secondary pipe portion 34 and the first main pipe portion 31 of the treatment unit 20*b* and the main pipe portion 30 of the treatment unit 20*a* are arranged along a straight line. Therefore, the extending portion 28 of the cathode 25 of the treatment unit 20*b* can be extended to the flow channel inside the main pipe portion 30 of the treatment unit 20*a* adjacent to the treatment unit 20*b*. As a result, the region where the extending portion 28 of the cathode 25 and the inner circumferential surface 29*a* of the anode pipe 29 face each other can be further increased. In this case, a single cathode 25 can be used as the cathode for the treatment unit 20*a* and the cathode for the treatment unit 20*b*.

Further, in Variation Example 7, the insulating member 53 is provided at the distal end portion 28*a* of the cathode 25 in order to prevent the cathode 25 from coming into contact with the inner circumferential surface 29*a* of the anode pipe 29. When the extending portion 28 is long, the extending portion 28 can be easily deflected under gravity or by a pressure created by the flow of the treatment liquid L. Therefore, it is preferred that the insulating member 53 be provided in a zone on the side of the distal end portion 28*a* with respect to the center of the extending portion 28 in the longitudinal direction, and it is even more preferred that the insulating member 53 be provided at the distal end portion 28*a* of the extending portion 28 or in the vicinity thereof.

The insulating member 53 extends from the distal end portion 28*a* of the extending portion 28 outwardly in the radial direction of the main pipe portion 30. Examples of suitable shape of the insulating member 53 include a shape that extends in a rod-like fashion from the extending portion 28 to both sides toward the inner circumferential surface 30*a* of the main pipe portion 30, a shape that extends radially (for example, in a cross-like manner) from the extending portion 28 toward the inner circumferential surface 30*a* of the main pipe portion 30, and a round disk shape. From the standpoint of ensuring a smooth flow of the treatment liquid L in the main pipe portion 30, it is preferred that the insulating member 53 have a rod-like or radial shape.

In Variation Example 7, the insulating member 53 is provided at the distal end portion 28*a* of the extending portion 28, but the insulating member 53 may not be necessarily provided at the distal end portion 28*a* of the extending portion 28. However, when the elongated extending portion 28 is deflected, it is the position of the distal end portion 28*a* of the extending portion 28 that changes the most. Accordingly, it is preferred that the insulating member 53 be provided at the distal end portion 28*a* of the extending portion 28.

<Variation Example 8>

Figure 12:
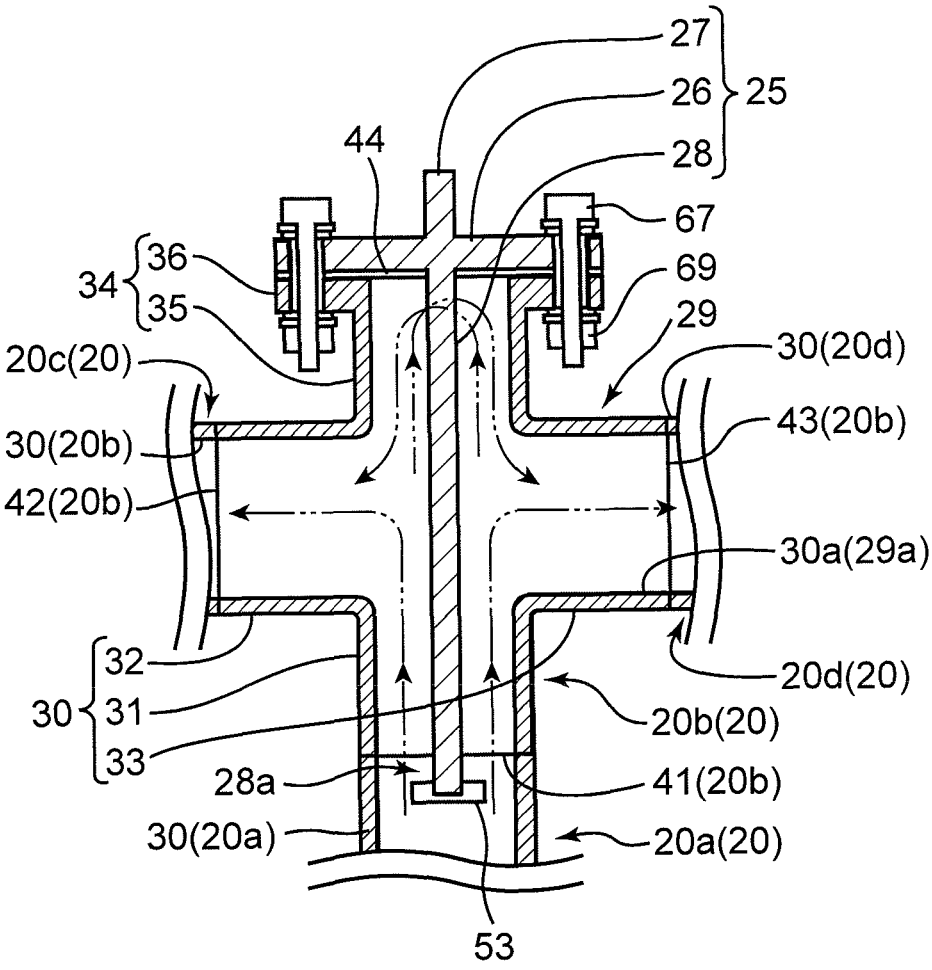
FIG. 12 is a cross-sectional view illustrating Variation Example 8 of the electrolytic regeneration unit.

FIG. 12 is a cross-sectional view illustrating Variation Example 8 of the treatment unit 20. The treatment unit 20 of Variation Example 8 differs from the treatment unit of Variation Example 7 in that the anode pipe 29 is a cross-shaped pipe.

In Variation Example 8, the anode pipe 29 has the main pipe portion 30 and the secondary pipe portion 34. The main pipe portion 30 has a third main pipe portion 33 in addition to the first main pipe portion 31 and the second main pipe portion 32. The first main pipe portion 31 and the secondary pipe portion 34 are arranged along a straight line. The second main pipe portion 32 and the third main pipe portion 33 are arranged along a straight line. The extension direction of the first main pipe portion 31 and the secondary pipe portion 34 and the extension direction of the second main pipe portion 32 and the third main pipe portion 33 cross each other. These directions are, for example, perpendicular to each other.

The space inside the third main pipe portion 33 is connected to the space inside the first main pipe portion 31, the space inside the second main pipe portion 32, and the space inside the secondary pipe portion 34. The third main pipe portion 33 has a third connection end portion 43 positioned at the distal end thereof. The distal end of the main pipe portion 30 of the treatment unit 20*d* is connected to the third connection end portion 43.

The extending portion 28 of the cathode 25 extends beyond the secondary pipe portion 34 and reaches the flow channel in the first main pipe portion 31 that is linearly connected to the secondary pipe portion 34 in the same manner as in Variation Example 7. The distal end portion 28*a* of the extending portion 28 is positioned in the flow channel in the main pipe portion 30 of the treatment unit 20*a* connected to the upstream side of the treatment unit 20*b*.

FIG. 12 illustrates an example of the cross-shaped anode pipe 29 in which the treatment liquid L flowing in the first main pipe portion 31 is branched into the second main pipe portion 32 and the third main pipe portion 33. Part of the treatment liquid L flows also into the secondary pipe portion 34. The flow direction of the treatment liquid L is not limited to that shown in FIG. 12. For example, the treatment liquid L may also flow (merge) from two main pipe portions to one main pipe portion from among the first to third main pipe portions 31, 32, 33.

<Variation Example 9>

Figure 13:
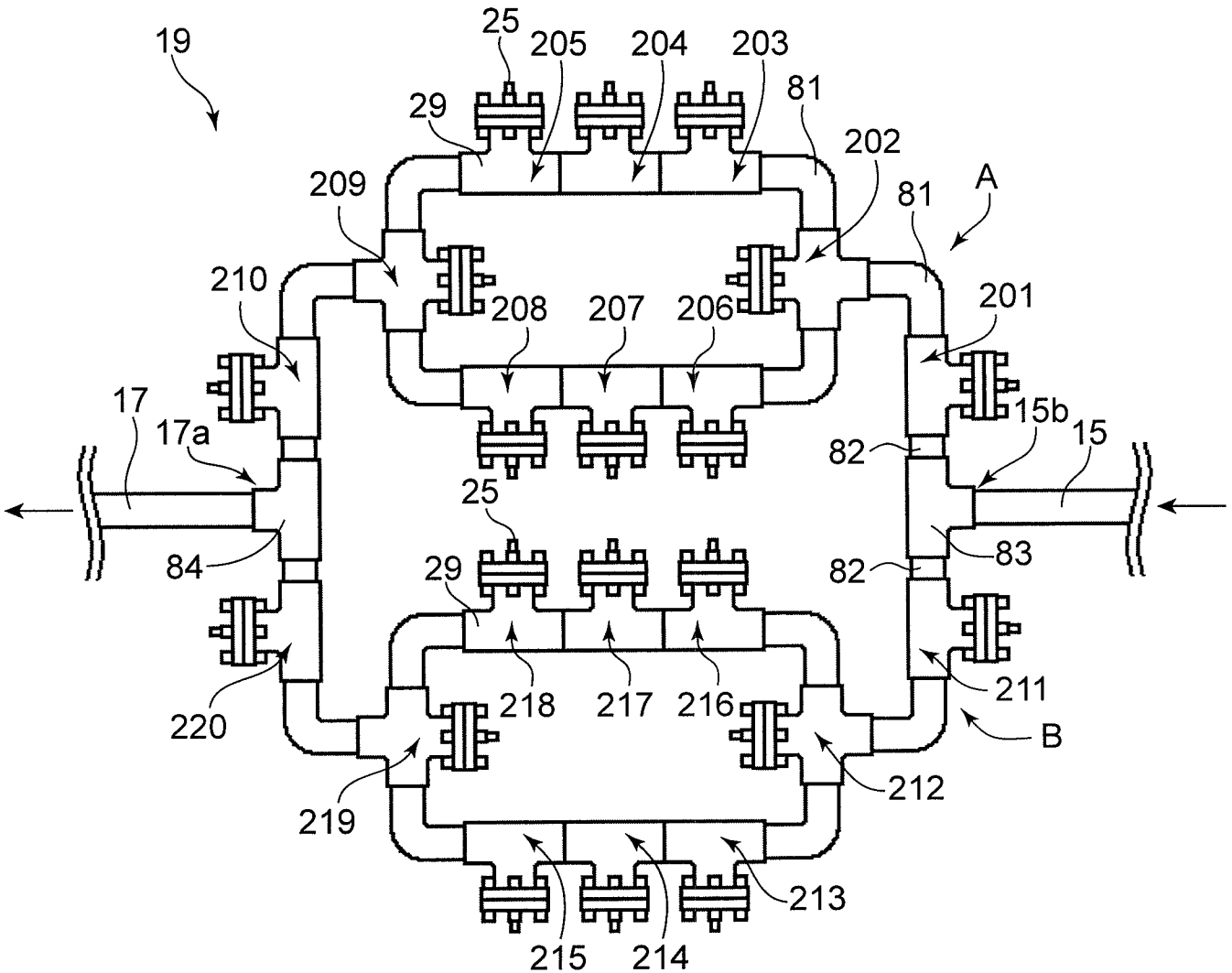
FIG. 13 is a cross-sectional view illustrating Variation Example 9 of the electrolytic regeneration unit.

FIG. 13 is a front view illustrating Variation Example 9 of the treatment unit 20. The configuration of the unit assembly 19 in Variation Example 9 is different from that in the aforementioned embodiment illustrated by FIG. 1.

As shown in FIG. 13, in Variation Example 9, the unit assembly 19 is constituted by connecting together a multiplicity of treatment units 20 (201 to 220). The multiplicity of treatment units 20 uses a T-shaped pipe or a cross-shaped pipe as the anode pipe 29. FIG. 13 shows an example of the connection pattern of those pipes, but this connection pattern of pipes is not limiting.

The upstream inlet of the unit assembly 19 through which the treatment liquid L flows into the unit assembly 19 is the end portion of a T-shaped pipe 83. A downstream outlet of the unit assembly 19 through which the treatment liquid L flows out of the unit assembly 19 is the end portion of a T-shaped pipe 84. The downstream end portion 15*b* of the feed pipe 15 is connected to the end portion of the T-shaped pipe 83. The upstream end portion 17*a* of the return pipe 17 is connected to the end portion of the T-shaped pipe 84.

Where the treatment liquid L flows into the T-shaped pipe 83, the treatment liquid is branched into two directions. More specifically, where the treatment liquid L flows into the T-shaped pipe 83, the treatment liquid is branched into a treatment block A constituted by the treatment units 201 to 210 and a treatment block B constituted by the treatment units 211 to 220. These treatment blocks A and B are in a mutual parallel connection relationship with the feed pipe 15 and the return pipe 17 in the unit assembly 19.

In the treatment block A, the treatment liquid L passes through the treatment unit 201, a L-shaped pipe 81, and the treatment unit 202 in the order of description and is branched into two directions in the treatment unit 202. One branched flow of the treatment liquid L passes through the treatment units 203, 204, and 205, and the other branched flow of the treatment liquid L passes through the treatment units 206, 207, and 208, and these flows merge in the treatment unit 209. The merged treatment liquid L passes through the treatment unit 210 and flows into the T-shaped pipe 84. The treatment units 203 to 205 are in a series connection relationship, and the treatment units 206 to 208 are also in a series connection relationship.

In the treatment block B, the treatment liquid L passes through the path similar to that of the treatment block A, flows into the T-shaped pipe 84, and merges with the treatment liquid L that has flown in the treatment block A in the T-shaped pipe 84. The merged treatment liquid L flows out of the unit assembly 19 and flows into the return pipe 17. The treatment liquid L is subjected to electrolytic regeneration in each of the treatment units 20.

By combining a plurality of treatment units using T-shaped pipes as the anode pipe 29 and a plurality of treatment units using cross-shaped pipes as the anode pipe 29, as described hereinabove, it is possible to form easily a plurality of flow channels in which parallel connection is present together with series connection, for example, as shown in FIG. 13. Therefore, the unit assembly 19 that has been combined so as to fit into the extra space in the electrolytic regeneration apparatus can be disposed therein and the extra space can be effectively used. Furthermore, already available products can be used as the T-shaped pipes and cross-shaped pipes.

<Variation Example 10>

Figure 14:
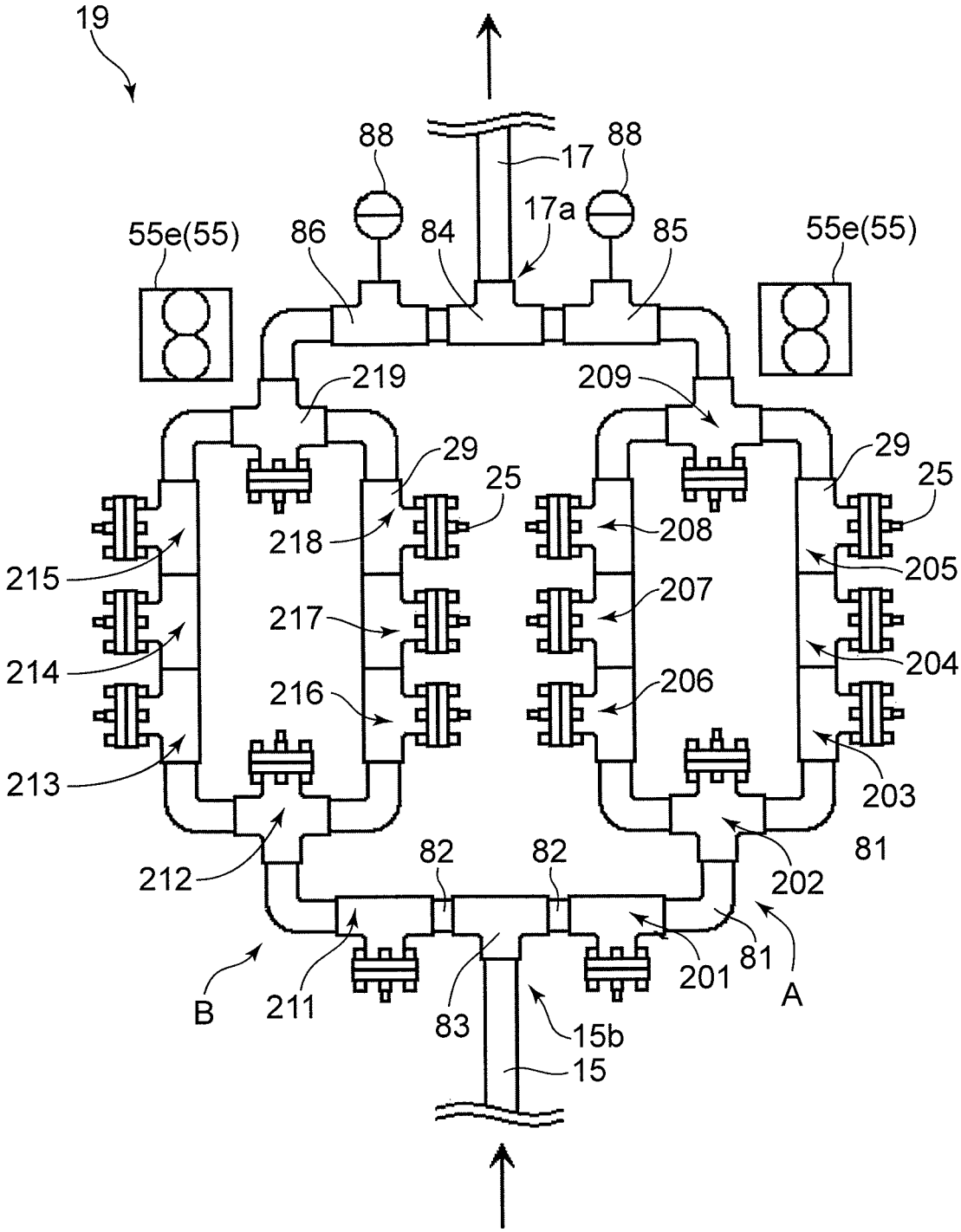
FIG. 14 is a cross-sectional view illustrating Variation Example 10 of the electrolytic regeneration unit.

FIG. 14 is a front view illustrating Variation Example 10 of the treatment unit 20. The difference between Variation Example 10 and Variation Example 9 is that the configuration of the former is provided with a gas discharge valve 88 and the temperature adjustment unit 55.

As shown in FIG. 14, in Variation Example 10, T-shaped pipes 85, 86 are provided instead of the treatment units 210, 220 in the locations of the treatment units 210, 220 in the unit assembly 19 shown in FIG. 13. The gas discharge pipe 88 is provided at each extending portion branched from the main pipe portions of the T-shaped pipes 85, 86. The unit assembly 19 of the Variation Example 10 is disposed so that the T-shaped pipes 85, 86 are positioned in the superior part of the unit assembly 19, as shown in FIG. 14.

Further, two cooling fans 55*e* are provided as the temperature adjustment units 55 in the vicinity of the unit assembly 19. One cooling fan 55*e* is provided in the vicinity of the treatment block A and can blow the air to the treatment units 20 of the treatment block A and cool the treatment units 20. The other cooling fan 55*e* is provided in the vicinity of the treatment block B and can blow the air to the treatment units 20 of the treatment block B and cool the treatment units 20.

In each treatment unit 20 (201 to 209 and 211 to 219), manganates contained in the treatment liquid L are regenerated to permanganates by the electrolytic regeneration of the treatment liquid L, but sludge containing manganese dioxide ($MnO_2$) as the main component is generated on the surface of the cathode 25. In order to remove the sludge from the surface of the cathode 25, it is preferred that a hydrogen peroxide solution be periodically circulated to each treatment unit 20 to wash the cathode 25. Where such washing is performed, a gas is generated due to a chemical reaction.

In Variation Example 10, since the gas discharge valve 88 is provided, the gas generated by the washing can be discharged to the outside of the unit assembly 19. For example, a pressure valve that opens when the pressure inside the T-shaped pipes 85, 86 exceeds a predetermined value or an automatically controlled electromagnetic valve can be used as the gas discharge valve 88.

In particular, since the unit assembly 19 of the Variation Example 10 is disposed so that the T-shaped pipes 85, 86 are positioned at the superior part, as shown in FIG. 14, the gas generated in each treatment unit 20 is fed upward together with the treatment liquid L along the flow direction of the treatment liquid L and reaches the T-shaped pipes 85, 86. Therefore, the generated gas is unlikely to accumulate in parts of the unit assembly 19.

For example, a method by which a hydrogen peroxide solution is introduced instead of the treatment liquid L into the desmearing tank 13 and the hydrogen peroxide solution is circulated in the treatment units 20 in the same manner as the treatment liquid L can be used as specific means for washing.

<Summary of Embodiments>

The above-described embodiments are summarized below.

In the embodiment and variation examples, the treatment liquid that has been used for desmearing in the desmearing tank flows into the anode pipe through the first connection end portion or the second connection end portion and passes through the main pipe portion of the anode pipe. Meanwhile, the cathode extends from the cathode attachment end portion toward the main pipe portion inside the secondary pipe portion. Therefore, by applying a voltage between the cathode and the inner circumferential surface of the anode pipe functioning as the anode, it is possible to perform electrolytic regeneration of the treatment liquid passing through the main pipe portion. Thus, the anode pipe functions as the anode and also as a flow channel for the treatment liquid. Therefore, with such a configuration, by contrast with the conventional configuration in which the treatment liquid is stored in an electrolytic regeneration tank and the cathode and anode are immersed into the treatment liquid, the electrolytic regeneration tank is not required and therefore the electrolytic regeneration apparatus can be reduced in size and the bath amount can be reduced.

Further, in such a configuration, the anode pipe is provided with the secondary pipe portion in addition to the main pipe portion that forms the flow channel for the treatment liquid. Therefore, the electrolytic regeneration unit can be constructed by attaching the cathode to the cathode attachment end portion.

Furthermore, with such a configuration, since the main pipe portion has the first connection end portion and the second connection end portion, the unit assembly provided with a plurality of electrolytic regeneration units can be constructed by joining the plurality of electrolytic regeneration units by using the first connection end portion and/or the second connection end portion.

In the anode pipe of the above-described embodiments and Variation Examples 1 to 6, 9, and 10, the main pipe portion has a tubular shape extending linearly from the first connection end portion to the second connection end portion, and the secondary pipe portion extends in the direction perpendicular to the main pipe portion. A T-shaped pipe and a cross-shaped pipe are suitable as the anode pipe. However, the secondary pipe portion is not necessarily required to extend in the direction perpendicular to the main pipe portion, provided that the secondary pipe portion extends in the direction crossing the main pipe portion. Thus, the secondary pipe portion may extend in the direction inclined with respect to the main pipe portion.

In Variation Example 3, the auxiliary anode is further provided that is electrically connected to the anode pipe and disposed opposite the cathode at a distance from the cathode. With such a configuration, since the auxiliary anode is provided, the anode surface area can be increased over that attained when the part functioning as the anode is only the inner circumferential surface of the anode pipe. As a result, the amount of current that can be supplied to the electrolytic regeneration unit can be increased and therefore the electrolytic regeneration capacity can be increased.

Further, in Variation Example 3, the distal end portion of the cathode is positioned in the flow channel inside the main pipe portion beyond the secondary pipe portion, and the auxiliary anode is provided at a position facing at least the distal end portion of the cathode. With such a configuration, the main pipe portion has a linearly extending tubular shape, the secondary pipe portion extends in the direction perpendicular to the main pipe portion, and the distal end portion of the cathode that is positioned in the flow channel inside the main pipe portion beyond the secondary pipe portion faces the auxiliary anode, without being surrounded by the inner circumferential surface of the secondary pipe portion. Therefore, the electrolytic regeneration can be efficiently performed also in the region between the distal end portion of the cathode and the auxiliary anode positioned opposite thereto.

Further, in Variation Example 3, the auxiliary anode has a tubular shape extending along the cathode so as to surround the periphery of the cathode, the part of the auxiliary anode at the proximal end side thereof is in contact with the inner circumferential surface of the secondary pipe portion, and the part of the auxiliary anode at the distal end side thereof is positioned in the flow channel inside the main pipe portion, surrounds the distal end portion of the cathode, and has a plurality of through holes such that the treatment liquid flowing in the flow channel inside the main pipe portion can pass therethrough. In such a configuration, since the plurality of through holes is provided in the part of the auxiliary anode at the distal end side thereof that is positioned in the flow channel inside the main pipe portion and surrounds the distal end portion of the cathode, the electrolytic regeneration of the treatment liquid can be efficiently performed in the region between the distal end portion of the cathode and the part of the auxiliary anode at the distal end side thereof, and the increase in resistance to the circulation of the treatment liquid flowing through the flow channel inside the main pipe portion can be inhibited. Further, with such a configuration, the auxiliary anode can be disposed in the anode pipe by inserting the tubular auxiliary anode into the secondary pipe portion from the cathode attachment end portion.

Further, in Variation Example 3, a plurality of through holes are formed in the part of the auxiliary anode, which is in contact with the inner circumferential surface of the secondary pipe portion, at the proximal end side thereof over the entire part at the proximal end side. Therefore, the anode surface area can be increased by comparison with the case where no through holes are formed in the part of the auxiliary anode at the proximal end side thereof and the entire inner circumferential surface of the secondary pipe portion is covered by the auxiliary anode.

More specifically, in Variation Example 3, a configuration obtained by cylindrically rounding a mesh-like conductive sheet (FIG. 7A) and a configuration obtained by cylindrically rounding a conductive punching sheet (FIG. 7B) are presented as examples of the auxiliary anode. In such auxiliary anodes, a plurality of through holes is formed over a substantially entire surface. Therefore, the increase in resistance to the circulation of the treatment liquid flowing through the flow channel inside the main pipe portion in the part of the auxiliary anode at the distal end side thereof can be inhibited. Furthermore, since a plurality of through holes is also formed in the part of the auxiliary anode at the proximal end side thereof, the treatment liquid also reaches the inner circumferential surface of the secondary pipe portion via the through holes (the part at the distal end side is in contact with or in proximity to the inner circumferential surface of the secondary pipe portion). Therefore, the inner circumferential surface of the secondary pipe portion still functions as the anode. The anode function is thus augmented substantially according to the surface area of the auxiliary anode and the surface area of the anode as a whole can be greatly increased.

In Variation Examples 7 and 8, in the anode pipe the main pipe portion has a bent shape including the first main pipe portion and the second main pipe portion extending in the mutually perpendicular directions, and the secondary pipe portion is connected to a bent portion of the main pipe portion so that the secondary pipe portion and the first main pipe portion are arranged along a straight line. For example, a T-shaped pipe and a cross-shaped pipe are suitable as such an anode pipe. However, the first main pipe portion and the second main pipe portion are not necessarily required to extend in the mutually perpendicular directions, provided that the first main pipe portion and the second main pipe portion extend in the direction crossing each other. Thus, the first main pipe portion may extend in the direction inclined with respect to the second main pipe portion.

In Variation Examples 7 and 8, the cathode extends beyond the secondary pipe portion as far as the flow channel inside the first main pipe portion or as far as a position beyond the secondary pipe portion and the first main pipe portion. When the secondary pipe portion is arranged along a straight line with the first main pipe portion as in such a configuration, a configuration in which the cathode extends beyond the secondary pipe portion as far as the flow channel inside the first main pipe portion and a configuration in which the cathode extends as far as a position beyond the secondary pipe portion and the first main pipe portion can be used in the electrolytic regeneration unit. As a result, the region in which the cathode and the inner circumferential surface of the main pipe portion face each other can be increased. Therefore, the efficiency of electrolytic regeneration can be further increased.

In Variation Examples 7 and 8, an auxiliary anode that is electrically connected to the anode pipe and disposed opposite the cathode at a distance from the cathode may be further provided. In the case of such a configuration, since the auxiliary anode is provided, the anode surface area can be increased over that attained when the part functioning as the anode is only the inner circumferential surface of the anode pipe. As a result, the amount of current that can be supplied to the electrolytic regeneration unit can be increased and therefore the electrolytic regeneration capacity can be increased.

In the aforementioned embodiments and variation examples, the cathode includes a base portion attached to the cathode attachment end portion of the secondary pipe portion, and an extending portion that extends from the base portion toward the main pipe portion. With such a configuration, the extending portion can be positioned at a desired position inside the anode pipe by inserting the extending portion of the cathode from the cathode attachment end portion of the secondary pipe portion into the secondary pipe portion and attaching the base portion of the cathode to the cathode attachment end portion of the secondary pipe portion. Further, because of a structure in which the base portion and the flange portion of the secondary pipe portion are fixed by a bolt and a nut in a state in which an insulating packing is interposed between the base portion and the flange portion of the secondary pipe portion, electric insulation therebetween can be maintained and leakage of liquid from therebetween can be effectively prevented. Furthermore, it is suffice if the cathode has a part facing the inner circumferential surface of the anode pipe and it is not always necessary to use the configuration including the base portion and the extending portion.

In Variation Examples 7 and 8, an insulating member is further provided that is attached to the cathode for preventing contact between the cathode and the inner circumferential surface of the anode pipe, and that extends from the cathode to the inner circumferential surface of the anode pipe. With such a configuration, since the insulating member is attached to the cathode, even when the cathode has moved in the direction of approaching the inner circumferential surface of the anode pipe, for example, because of bending deformation of the cathode, the insulating member comes into contact with the inner circumferential surface of the anode pipe before the cathode comes into contact with the inner circumferential surface of the anode pipe. As a result, contact between the cathode and the inner circumferential surface of the anode pipe can be prevented. The insulating member can be also provided in embodiments other than Variation Examples 7 and 8.

In Variation Examples 4 to 6 and 10, a temperature adjustment portion for adjusting a temperature of the anode pipe is further provided. In the electrolytic regeneration unit, the temperature of the treatment liquid can rise due to generation of heat during electrolytic regeneration. In the aforementioned configuration, since the temperature adjustment unit is provided, the decrease in quality of the treatment liquid caused by the increase in temperature of the treatment liquid can be prevented and the occurrence of failures in the apparatus that are caused by the increase in temperature of the treatment liquid can be also prevented. When the temperature adjustment unit includes not only cooling means for cooling the anode pipe, but also heating means, the temperature of the treatment liquid can be adjusted more accurately. The temperature adjustment unit can be also provided in embodiments other than Variation Examples 4 to 6 and 10.

In Variation Example 10, a gas discharge valve is further provided for discharging gas generated in the electrolytic regeneration unit. With such a configuration, the gas generated by electrolysis of the treatment liquid in the electrolytic regeneration unit can be discharged to the outside of the apparatus through the gas discharge valve. In Variation Example 10, the gas discharge valve is provided at the unit assembly, but such a configuration is not limiting. The gas discharge valve may be provided in a location other than the unit assembly. For example, the gas discharge valve may be provided at the return pipe. The gas discharge valve can be also provided in embodiments other than Variation Example 10.

The above-described specific embodiments mainly include the invention having the below-described features.

(1) The present invention relates to an electrolytic regeneration unit for use in an electrolytic regeneration apparatus for electrolyzing and regenerating a treatment liquid used for desmearing in a desmearing tank. The electrolytic regeneration unit is provided with an anode pipe having an inner circumferential surface functioning as an anode, and a cathode disposed inside the anode pipe at a distance from the inner circumferential surface of the anode pipe. The anode pipe includes a main pipe portion and a secondary pipe portion. The main pipe portion has a first connection end portion for connecting one pipe and a second connection end portion for connecting another pipe other than the one pipe and forms a flow channel for the treatment liquid that continues from the first connection end portion to the second connection end portion. The secondary pipe portion has a cathode attachment end portion for attaching the cathode, extends in a tubular fashion from an intermediate section of the main pipe portion. The interior of the secondary pipe communicates with the flow channel in the main pipe portion. The cathode extends inside the secondary pipe portion from the cathode attachment end portion toward the main pipe portion.

With such a configuration, the treatment liquid that has been used for desmearing in the desmearing tank flows into the anode pipe through the first connection end portion or the second connection end portion and passes through the main pipe portion of the anode pipe. Meanwhile, the cathode extends from the cathode attachment end portion toward the main pipe portion inside the secondary pipe portion. Therefore, by applying a voltage between the cathode and the inner circumferential surface of the anode pipe functioning as the anode, it is possible to perform electrolytic regeneration of the treatment liquid passing through the main pipe portion. Thus, the anode pipe functions as the anode and also as a flow channel for the treatment liquid. Therefore, with such a configuration, by contrast with the conventional configuration in which the treatment liquid is stored in an electrolytic regeneration tank and the cathode and anode are immersed into the treatment liquid, the electrolytic regeneration tank is not required and therefore the electrolytic regeneration apparatus can be reduced in size and the bath amount can be reduced.

Further, in such a configuration, the anode pipe is provided with the secondary pipe portion in addition to the main pipe portion that forms the flow channel for the treatment liquid. Therefore, the electrolytic regeneration unit can be constructed by attaching the cathode to the cathode attachment end portion.

Furthermore, with such a configuration, since the main pipe portion has the first connection end portion and the second connection end portion, the unit assembly provided with a plurality of electrolytic regeneration units can be constructed by joining the plurality of electrolytic regeneration units by using the first connection end portion and/or the second connection end portion.

(2) In the aforementioned electrolytic regeneration unit, it is preferred that in the anode pipe the main pipe portion have a tubular shape extending linearly from the first connection end portion to the second connection end portion, and the secondary pipe portion extend in a direction crossing the main pipe portion. For example, a T-shaped pipe and a cross-shaped pipe are suitable as the anode pipe.

(3) The electrolytic regeneration unit as described in clause (2) above preferably further includes an auxiliary anode that is electrically connected to the anode pipe and disposed opposite the cathode at a distance from the cathode.

With such a configuration, since the auxiliary anode is provided, the anode surface area can be increased over that attained when the part functioning as the anode is only the inner circumferential surface of the anode pipe. As a result, the amount of current that can be supplied to the electrolytic regeneration unit can be increased and therefore the electrolytic regeneration capacity can be increased.

(4) In the electrolytic regeneration unit as described in clause (3) above, it is preferred that the distal end portion of the cathode be positioned in the flow channel inside the main pipe portion beyond the secondary pipe portion, and the auxiliary anode be provided at a position facing at least the distal end portion of the cathode.

With such a configuration, the main pipe portion has a linearly extending tubular shape, the secondary pipe portion extends in the direction crossing the main pipe portion, and the distal end portion of the cathode that is positioned in the flow channel inside the main pipe portion beyond the secondary pipe portion faces the auxiliary anode, without being surrounded by the inner circumferential surface of the secondary pipe portion. Therefore, the electrolytic regeneration can be efficiently performed also in the region between the distal end portion of the cathode and the auxiliary anode positioned opposite thereto.

(5) In the electrolytic regeneration unit as described in clause (4) above, it is preferred that the auxiliary anode have a tubular shape extending along the cathode so as to surround the periphery of the cathode, a part of the auxiliary anode at the proximal end side thereof be in contact with or in proximity to the inner circumferential surface of the secondary pipe portion, and a part of the auxiliary anode at the distal end side thereof be positioned in the flow channel inside the main pipe portion, surround the distal end portion of the cathode, and have a plurality of through holes such that the treatment liquid flowing in the flow channel inside the main pipe portion can pass therethrough.

In such a configuration, since the plurality of through holes is provided in the part of the auxiliary anode at the distal end side thereof that is positioned in the flow channel inside the main pipe portion and surrounds the distal end portion of the cathode, the electrolytic regeneration of the treatment liquid can be efficiently performed in the region between the distal end portion of the cathode and the part of the auxiliary anode at the distal end side thereof, and the increase in resistance to the circulation of the treatment liquid flowing through the flow channel inside the main pipe portion can be inhibited.

Further, with such a configuration, the auxiliary anode can be disposed in the anode pipe by inserting the tubular auxiliary anode into the secondary pipe portion from the cathode attachment end portion.

(6) In the electrolytic regeneration unit as described in clause (1) above, it is preferred that in the anode pipe the main pipe portion have a bent shape including a first main pipe portion and a second main pipe portion respectively extending in directions crossing each other, and the secondary pipe portion be connected to a bent portion of the main pipe portion so that the secondary pipe portion and the first main pipe portion are arranged along a straight line. For example, a T-shaped pipe and a cross-shaped pipe are suitable as such an anode pipe.

(7) In the electrolytic regeneration unit as described in clause (6) above, it is preferred that the cathode extend beyond the secondary pipe portion as far as the flow channel inside the first main pipe portion or as far as a position beyond the secondary pipe portion and the first main pipe portion.

In such a configuration, the anode pipe is such as described in clause (6) above, and the secondary pipe portion is arranged along a straight line with the first main pipe portion. Therefore, a configuration in which the cathode extends beyond the secondary pipe portion as far as the flow channel inside the first main pipe portion and a configuration in which the cathode extends as far as a position beyond the secondary pipe portion and the first main pipe portion can be used in the electrolytic regeneration unit. As a result, the region in which the cathode and the inner circumferential surface of the main pipe portion face each other can be increased. Therefore, the efficiency of electrolytic regeneration can be further increased.

(8) The electrolytic regeneration unit according to clause (1), (6), or (7) above preferably additionally includes an auxiliary anode that is electrically connected to the anode pipe and disposed opposite the cathode at a distance from the cathode.

With such a configuration, since the auxiliary anode is provided, the anode surface area can be increased over that attained when the part functioning as the anode is only the inner circumferential surface of the anode pipe. As a result, the amount of current that can be supplied to the electrolytic regeneration unit can be increased and therefore the electrolytic regeneration capacity can be increased.

(9) In the aforementioned electrolytic regeneration unit, it is preferred that the cathode include a base portion attached to the cathode attachment end portion of the secondary pipe portion, and an extending portion that extends from the base portion toward the main pipe portion.

With such a configuration, the extending portion can be positioned at a desired position inside the anode pipe by inserting the extending portion of the cathode from the cathode attachment end portion of the secondary pipe portion into the secondary pipe portion and attaching the base portion of the cathode to the cathode attachment end portion of the secondary pipe portion.

(10) The aforementioned electrolytic regeneration unit preferably further includes an insulating member that is attached to the cathode for preventing contact between the cathode and the inner circumferential surface of the anode pipe, and that extends from the cathode to the inner circumferential surface of the anode pipe.

With such a configuration, since the insulating member is attached to the cathode, even when the cathode has moved in the direction of approaching the inner circumferential surface of the anode pipe, for example, because of bending deformation of the cathode, the insulating member comes into contact with the inner circumferential surface of the anode pipe before the cathode comes into contact with the inner circumferential surface of the anode pipe. As a result, contact between the cathode and the inner circumferential surface of the anode pipe can be prevented.

(11) The aforementioned electrolytic regeneration unit preferably further includes a temperature adjustment portion for adjusting a temperature of the anode pipe.

In the electrolytic regeneration unit, the temperature of the treatment liquid can rise due to generation of heat during electrolytic regeneration. In the aforementioned configuration, since the temperature adjustment unit is provided, the decrease in quality of the treatment liquid caused by the increase in temperature of the treatment liquid can be prevented and the occurrence of failures in the apparatus that are caused by the increase in temperature of the treatment liquid can be also prevented. When the temperature adjustment unit includes not only cooling means for cooling the anode pipe, but also heating means, the temperature of the treatment liquid can be adjusted more accurately.

(12) The electrolytic regeneration apparatus in accordance with the present invention includes the aforementioned electrolytic regeneration unit, a feed pipe that guides the treatment liquid discharged from the desmearing tank to the electrolytic regeneration unit, and a return pipe that guides the treatment liquid discharged from the electrolytic regeneration unit to the desmearing tank.

With such a configuration, the treatment liquid discharged from the desmearing tank directly flows into the electrolytic regeneration unit through the feed pipe. The treatment liquid that has flown into the anode pipe of the electrolytic regeneration unit is electrolyzed and regenerated as it passes through the main pipe portion of the anode pipe. The treatment liquid that has been discharged from the electrolytic regeneration unit is guided into the desmearing tank through the return pipe.

(13) In the aforementioned electrolytic regeneration apparatus, it is preferred that the electrolytic regeneration unit be provided in plurality, and those electrolytic regeneration units be connected to each other to configure a unit assembly. In this case, the treatment liquid discharged from the desmearing tank is guided to the unit assembly through the feed pipe, and the treatment liquid discharged from the unit assembly is returned to the desmearing tank through the return pipe.

The main pipe portion of the anode pipe in the aforementioned electrolytic regeneration unit has the first connection end portion and the second connection end portion. Therefore, the unit assembly provided with a plurality of electrolytic regeneration units can be constructed by joining the plurality of electrolytic regeneration units by using the first connection end portion and/or the second connection end portion. In the electrolytic regeneration apparatus equipped with such a unit assembly, the capacity of electrolytically regenerating the treatment liquid can be increased by comparison with that of the electrolytic regeneration apparatus provided with only one electrolytic regeneration unit.

(14) The aforementioned electrolytic regeneration apparatus is preferably further provided with a gas discharge valve for discharging the gas generated in the electrolytic regeneration unit.

With such a configuration, the gas generated by electrolysis of the treatment liquid in the electrolytic regeneration unit can be discharged to the outside of the apparatus through the gas discharge valve.

<Other Embodiments>

The embodiment of the electrolytic regeneration apparatus in accordance with the present invention is described above, but the present invention is not limited to the embodiment and various changes and modification can be made without departing from the essence of the present invention.

For example, in the embodiment, a case where a permanganate solution is used as the treatment liquid is explained by way of example, but this selection is not limiting.

In the embodiment, the case where the anode pipe is a T-shaped or cross-shaped pipe is explained by way of example, but this configuration is not limiting. Thus, an Y-shaped pipe in which a first main pipe portion, a second main pipe portion, and a secondary pipe portion extend in three different directions from the center may be used as the anode pipe.

In Variation Example 3 of the embodiment, the case in which the auxiliary anode 51 has a tubular shape such that covers the entire periphery of the extending portion 28 of the cathode 25 is explained by way of example, but such a configuration is not limiting. The auxiliary anode 51 may be configured to face, for example, only part of the extending portion 28 positioned in the flow channel inside the main pipe portion 30, rather than the entire periphery of the extending portion 28 of the cathode 25.

Further, the case is explained in which the part 51*a* at the proximal end side of the auxiliary anode 51 is in contact with the inner circumferential surface 34*a* of the secondary pipe portion 34, but it is not always necessary that the part 51*a* at the proximal end side of the auxiliary anode 51 be in contact with the inner circumferential surface 34*a* of the secondary pipe portion 34, provided that another means for ensuring electric contact with the auxiliary anode 51 with the anode pipe 29 is employed. More specifically, for example, the part 51*a* at the proximal end side of the auxiliary anode 51 may be electrically connected by a conductive material (not shown in the figure) to the inner circumferential surface 34*a* of the secondary pipe portion 34 while the part 51*a* is in proximity to the inner circumferential surface 34*a*.

Further, in the aforementioned embodiment, the case where an auxiliary anode is provided for increasing the anode surface area is explained by way of example, but it is also possible to increase the anode surface area by providing a plurality of protrusions and depressions on the inner circumferential surface of the anode pipe. Further, an auxiliary anode provided with a plurality of protrusions and depressions on the surface may be also used.

Further, in the embodiment, the cathode 25 in which the base portion 26, the extending portion 28, and the wiring connection portion 27 are molded integrally is explained by way of example, but such a configuration is not limiting. For example, the base portion 26 and the extending portion 28 may be formed as separate bodies. Furthermore, in the case where the base portion 26 is formed from an insulating material, the aforementioned insulating packing 59 can be omitted.

Further, the cathode 25 may be a simple rod-shaped or plate-shaped member. In this case, the treatment unit 20 can be constructed, for example, by inserting the cathode 25 into the through hole of the insulating packing and fitting the insulating packing into the cathode attachment end portion of the secondary pipe portion 34.

This application is based on Japanese patent application No. 2011-115689, filed in Japan Patent Office on May 24, 2011, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An electrolytic regeneration unit for use in an electrolytic regeneration apparatus for electrolyzing and regenerating a treatment liquid used for desmearing in a desmearing tank, the electrolytic regeneration unit comprising:

an anode pipe having an inner circumferential surface functioning as an anode; and a cathode disposed inside the anode pipe at a distance from the inner circumferential surface of the anode pipe, wherein the anode pipe includes:

a main pipe portion that has a first connection end portion for connecting one pipe and a second connection end portion for connecting another pipe other than the one pipe, and forms a flow channel for the treatment liquid that continues from the first connection end portion to the second connection end portion; and a secondary pipe portion that has a cathode attachment end portion for attaching the cathode, extends in a tubular fashion from an intermediate section of the main pipe portion, the interior of the secondary pipe portion communicates with the flow channel inside the main pipe portion, and the cathode extends inside the secondary pipe portion from the cathode attachment end portion toward the main pipe portion.

2. The electrolytic regeneration unit according to claim 1, wherein the main pipe portion has a tubular shape extending linearly from the first connection end portion to the second connection end portion, and the secondary pipe portion extends in a direction crossing the main pipe portion.

3. The electrolytic regeneration unit according to claim 2, further comprising an auxiliary anode that is electrically connected to the anode pipe and disposed opposite the cathode at a distance from the cathode.

4. The electrolytic regeneration unit according to claim 3, wherein a distal end portion of the cathode is positioned in the flow channel inside the main pipe portion beyond the secondary pipe portion, and the auxiliary anode is provided at a position facing at least the distal end portion of the cathode.

5. The electrolytic regeneration unit according to claim 4, wherein the auxiliary anode has a tubular shape extending along the cathode so as to surround a periphery of the cathode, a part of the auxiliary anode at a proximal end side thereof is in contact with or in proximity to an inner circumferential surface of the secondary pipe portion, and a part of the auxiliary anode at the distal end side thereof is positioned in the flow channel inside the main pipe portion, surrounds the distal end portion of the cathode, and has a plurality of through holes such that the treatment liquid flowing in the flow channel inside the main pipe portion can pass therethrough.

6. The electrolytic regeneration unit according to claim 1, wherein the main pipe portion has a bent shape including a first main pipe portion and a second main pipe portion respectively extending in directions crossing each other, and the secondary pipe portion is connected to a bent portion of the main pipe portion so that the secondary pipe portion and the first main pipe portion are arranged along a straight line.

7. The electrolytic regeneration unit according to claim 6, wherein the cathode extends beyond the secondary pipe portion as far as the flow channel inside the first main pipe portion or as far as a position beyond the secondary pipe portion and the first main pipe portion.

8. The electrolytic regeneration unit according to claim 6, further comprising an auxiliary anode that is electrically connected to the anode pipe and disposed opposite the cathode at a distance from the cathode.

9. The electrolytic regeneration unit according to claim 1, wherein the cathode includes:

a base portion attached to the cathode attachment end portion of the secondary pipe portion; and an extending portion that extends from the base portion toward the main pipe portion.

10. The electrolytic regeneration unit according to claim 1, further comprising:

an insulating member that is attached to the cathode for preventing contact between the cathode and the inner circumferential surface of the anode pipe, and that extends from the cathode to the inner circumferential surface of the anode pipe.

11. The electrolytic regeneration unit according to claim 1, further comprising:

a temperature adjustment portion for adjusting a temperature of the anode pipe.

12. An electrolytic regeneration apparatus comprising:

the electrolytic regeneration unit according to claim 1;

a feed pipe that guides the treatment liquid discharged from the desmearing tank to the electrolytic regeneration unit; and a return pipe that guides the treatment liquid discharged from the electrolytic regeneration unit to the desmearing tank.

13. The electrolytic regeneration apparatus according to claim 12, wherein the electrolytic regeneration unit is provided in plurality, and those electrolytic regeneration units are connected to each other to configure a unit assembly, and the treatment liquid discharged from the desmearing tank is guided to the unit assembly through the feed pipe, and the treatment liquid discharged from the unit assembly is returned to the desmearing tank through the return pipe.

14. The electrolytic regeneration apparatus according to claim 12, further comprising:

a gas discharge valve for discharging gas generated in the electrolytic regeneration unit.

* * * * *